US009038409B2

(12) United States Patent
Hwang et al.

(10) Patent No.: US 9,038,409 B2
(45) Date of Patent: May 26, 2015

(54) APPARATUS FOR TREATING AIR BY USING POROUS ORGANIC-INORGANIC HYBRID MATERIALS AS AN ABSORBENT

(75) Inventors: Young Kyu Hwang, Daejeon (KR); Jong-San Chang, Daejeon (KR); Dong Won Hwang, Gyeonggi-do (KR); Ji Sun Lee, Busan (KR)

(73) Assignee: Korea Research Institute of Chemical Technology (KR)

( * ) Notice: Subject to any disclaimer, the term of this patent is extended or adjusted under 35 U.S.C. 154(b) by 1145 days.

(21) Appl. No.: 12/629,841

(22) Filed: Dec. 2, 2009

(65) Prior Publication Data

US 2011/0067426 A1 Mar. 24, 2011

(30) Foreign Application Priority Data

Sep. 21, 2009 (KR) ..... 10-2009-0088902
Nov. 19, 2009 (KR) ..... 10-2009-0111937

(51) Int. Cl.

| | |
|---|---|
| ***F25D 23/00*** | (2006.01) |
| ***F23L 15/02*** | (2006.01) |
| ***F24F 3/14*** | (2006.01) |
| *F28D 19/04* | (2006.01) |

(52) U.S. Cl.

CPC ..... *F24F 3/1411* (2013.01); *F24F 2203/1036* (2013.01); *F24F 2203/1072* (2013.01); *F28D 19/041* (2013.01)

(58) Field of Classification Search

USPC ..... 62/271; 165/7, 8
See application file for complete search history.

(56) References Cited

U.S. PATENT DOCUMENTS

| | | | | | |
|---|---|---|---|---|---|
| 1,912,784 | A | * | 6/1933 | Miller et al. | 165/7 |
| 2,352,655 | A | * | 7/1944 | Olstad | 261/114.1 |
| 2,964,298 | A | * | 12/1960 | McIntosh et al. | 165/7 |
| 3,021,692 | A | * | 2/1962 | Gaugler | 62/271 |
| 3,446,031 | A | * | 5/1969 | Macriss et al. | 62/271 |
| 3,470,708 | A | * | 10/1969 | Weil et al. | 62/271 |
| 4,060,913 | A | * | 12/1977 | Yoshida et al. | 165/8 |

(Continued)

FOREIGN PATENT DOCUMENTS

| | | | |
|---|---|---|---|
| JP | 55-80703 | * | 6/1980 |
| JP | 56-97522 | * | 8/1981 |

(Continued)

OTHER PUBLICATIONS

Susumu Kitagawa et al., "Functional Porous Coordination Polymers", *Angew. Chem. Intl. Ed.*; 2004, 43, 2334-2375.

(Continued)

*Primary Examiner* — Ljiljana Ciric
(74) *Attorney, Agent, or Firm* — Martine Penilla Group, LLP

(57) ABSTRACT

The present disclosure provides an apparatus for treating air by using porous organic-inorganic hybrid materials as an absorbent, which comprises an inlet passage for receiving air from outside; a dehumidifying part comprising porous organic-inorganic hybrid materials as an adsorbent for removing moisture from the air receiving through the inlet passage; a regenerating unit for regenerating the adsorbent of the dehumidifying part; and an outlet passage for discharging the dehumidified air to outside. Said apparatus preferably comprises two dehumidifying parts of two-bed switching type and two switch valves, wherein said two dehumidifying parts are alternatively operated for dehumidification and for regeneration by switching said switch valves to convert direction of air flow.

14 Claims, 11 Drawing Sheets

(56) References Cited

U.S. PATENT DOCUMENTS

| | | | | | |
|---|---|---|---|---|---|
| 4,952,283 | A * | 8/1990 | Besik | 165/7 |
| 4,966,228 | A * | 10/1990 | Fawcett | 165/7 |
| 4,979,965 | A * | 12/1990 | Sannholm | 95/194 |
| 4,982,575 | A * | 1/1991 | Besik | 62/271 |
| 5,020,335 | A * | 6/1991 | Albers et al. | 62/271 |
| 5,353,606 | A * | 10/1994 | Yoho et al. | 62/271 |
| 5,660,048 | A * | 8/1997 | Belding et al. | 165/7 |
| 5,727,394 | A * | 3/1998 | Belding et al. | 62/271 |
| 5,758,511 | A * | 6/1998 | Yoho et al. | 62/271 |
| 5,765,395 | A * | 6/1998 | Menzenski | 62/611 |
| 6,018,953 | A * | 2/2000 | Belding et al. | 62/271 |
| 6,050,100 | A * | 4/2000 | Belding et al. | 62/271 |
| 6,565,999 | B1 * | 5/2003 | Haogland | 165/8 |
| 6,675,871 | B2 * | 1/2004 | Okano et al. | 165/8 |
| 6,709,496 | B2 * | 3/2004 | Viereck et al. | 96/111 |
| 6,711,907 | B2 * | 3/2004 | Dinnage et al. | 62/271 |
| 6,773,688 | B2 | 8/2004 | Mertens et al. | 423/306 |
| 6,892,795 | B1 * | 5/2005 | Steele | 165/8 |
| 6,959,875 | B2 * | 11/2005 | Yabu et al. | 165/7 |
| 7,047,751 | B2 * | 5/2006 | Dinnage et al. | 62/271 |
| 7,080,505 | B2 * | 7/2006 | Koermer et al. | 165/8 |
| 7,252,703 | B2 * | 8/2007 | MacKnight | 95/218 |
| 7,527,777 | B2 * | 5/2009 | Watanabe et al. | 423/305 |
| 7,704,305 | B2 * | 4/2010 | Nishida | 96/154 |
| 8,628,608 | B2 * | 1/2014 | Jensen et al. | 96/115 |
| 8,747,531 | B2 * | 6/2014 | Dinnage | 96/143 |
| 2001/0035280 | A1 * | 11/2001 | Okano et al. | 165/8 |
| 2002/0116934 | A1 * | 8/2002 | Dinnage et al. | 62/271 |
| 2002/0129614 | A1 * | 9/2002 | Dinnage et al. | 62/271 |
| 2003/0121271 | A1 * | 7/2003 | Dinnage et al. | 62/271 |
| 2003/0224504 | A1 * | 12/2003 | Blais et al. | 435/266 |
| 2004/0060315 | A1 * | 4/2004 | Dinnage et al. | 62/271 |
| 2004/0265199 | A1 * | 12/2004 | MacKnight | 423/220 |
| 2005/0050906 | A1 * | 3/2005 | Dinnage et al. | 62/271 |
| 2005/0252229 | A1 * | 11/2005 | Moratalla | 62/271 |
| 2006/0245994 | A1 * | 11/2006 | Watanabe et al. | 423/305 |
| 2007/0051243 | A1 * | 3/2007 | Boutall et al. | 62/271 |
| 2009/0130411 | A1 * | 5/2009 | Chang et al. | 428/219 |
| 2010/0107673 | A1 * | 5/2010 | Nakaguro et al. | 62/271 |
| 2010/0154455 | A1 * | 6/2010 | Yoon et al. | 62/271 |

FOREIGN PATENT DOCUMENTS

| | | | | |
|---|---|---|---|---|
| KR | 20010037883 | A | | 5/2001 |
| KR | 100578106 | B1 | | 5/2006 |
| KR | 100733347 | B1 | | 6/2007 |
| KR | 100792038 | B1 | | 12/2007 |
| KR | 100803945 | B1 | | 2/2008 |
| KR | 100816485 | B1 | | 3/2008 |
| KR | 100816538 | B1 | | 3/2008 |
| KR | 100864313 | B1 | | 10/2008 |
| WO | WO00/53978 | | * | 9/2000 |
| WO | WO 2007/091828 | A1 | | 8/2007 |
| WO | WO 2007/102676 | A1 | | 9/2007 |
| WO | WO 2007/105871 | A1 | | 9/2007 |
| WO | WO 2008/066293 | A1 | | 6/2008 |
| WO | WO 2008/072896 | A1 | | 6/2008 |
| WO | WO 2008/143385 | A1 | | 11/2008 |

OTHER PUBLICATIONS

Stuart L. James, "Metal-organic frameworks", *Chem. Soc. Rev.*, 2003, 32, 276-288.

M.J. Rosseinsky, "Recent developments in metal-organic framework chemistry: design, discovery, permanent porosity and flexibility", *Microporous Mesoporous Materials*, 2004, 73, 15-30.

G. Férey et al., "A Chromium Terephthalate-Based Solid with Unusually Large Pore Volumes and Surface Area", *Science*, 2005, 309, 2040-2042.

Patricia Horcajada et al., "Synthesis and catalytic properties of MIL-100(Fe), an iron(III) carboxylate with large pores", *Chemical Communication*, 2007, 2820-2822.

Stephen S.-Y. Chui et al., "A Chemically Functionalizable Nanoporous Material $[Cu_3(TMA)_2(H_2O)_3]_n$", *Science*, 1999, 283, 1148-1150.

Caskey, S.R et al, "Dramatic Tuning of Carbon Dioxide Uptake via Metal Substitution in a Coordination Polymer with Cylindrical Pores," *J. Am. Chem. Soc.*, 2008, 130 (33), 10870-10871.

Jasmina Hafizovic Cavka et al., "A New Zirconium Inorganic Building Brick Forming Metal Organic Frameworks with Exceptional Stability", *J. Am. Chem. Soc.*, 2008, 130(42), 13850-13851.

* cited by examiner

APPARATUS FOR TREATING AIR BY USING POROUS ORGANIC-INORGANIC HYBRID MATERIALS AS AN ABSORBENT

CROSS-REFERENCE TO RELATED APPLICATIONS

This patent application claims priority from and is related to Korean Patent Application No. 2009-0088902 filed Sep. 21, 2009, entitled "Apparatus For Treating Air," and Korean Patent Application No. 2009-011937 filed Nov. 19, 2009, entitled "Apparatus For Treating Air." Korean Patent Application No. 2009-0088902 and Korean Patent Application No. 2009-011937 are incorporated by reference in their entirety herein.

TECHNICAL FIELD

The present disclosure relates to an apparatus for treating air.

BACKGROUND

In various fields, there is an increasing need of humidity control and/or temperature control in the air. In the past, humidity and/or temperature were controlled using an air-conditioner or cooler. However, as it became necessary to provide drier air to the air-conditioned room as the latent heat load among the total cooling load increases, in cooling methods, the temperature of the evaporator or cooling coil had to be kept even lower in order to further lower the dew point. Accordingly, the provided air has to be reheated after being cooled when the temperature of the provided air gets lower more than necessary, and as the temperature of the air-conditioner or cooler gets lower, the cooling efficiency is deteriorated, and the energy efficiency of the overall system for treating air gets lower. Also, in case the target humidity is very low, the evaporator coil gets frosted, making it difficult to smoothly operate the system.

In order to supplement the above disadvantages, the desiccant-cooling system treats latent heat load using a desiccant (dehumidifying agent). In the past, solid dehumidifying agents such as activated carbon, activated alumina, silica gel, zeolite (molecular sieve), and liquid dehumidifying agents such as triethylene glycol, lithium chloride were used as dehumidifying agents. However, the prior dehumidifying agents do not provide a satisfactory dehumidifying efficiency, dehumidifying amount, etc., and need to be improved.

SUMMARY

The present disclosure provides in one embodiment an apparatus for treating air including porous organic-inorganic hybrid materials formed by binding a central metal ion with an organic ligand.

In one embodiment, an apparatus for treating air includes:

an inlet passage for receiving air from outside;

a dehumidifying part including an adsorbent for removing moisture from the air received through the inlet passage;

a regenerating unit for regenerating the adsorbent of the dehumidifying part; and an outlet passage for discharging the dehumidified air to outside.

In one embodiment, the adsorbent includes porous organic-inorganic hybrid materials formed by binding a central metal ion with an organic ligand.

In one embodiment, the dehumidifying part of the apparatus for treating air includes an adsorption area through which air received from the inlet passage passes, and a regeneration area through which air received from the regeneration passage passes. The regenerating unit of the apparatus for treating air includes a regeneration passage for receiving air outside the apparatus for treating air and/or circulating air in the apparatus for treating air, and a heating part connected with the regeneration passage. The moisture adsorbed in the adsorbent of the dehumidifying part is desorbed by providing heated air to the regeneration area of the dehumidifying part where the heating part heats air moving through the regeneration passage.

In one embodiment, the apparatus for treating air may further include a heat exchanger for exchanging heat between the air in the outlet passage and the air in the regeneration passage.

In one embodiment, the apparatus for treating air may further include in the outlet passage a cooling part for cooling the air dehumidified by the dehumidifying part.

In one embodiment, the dehumidifying part includes a cylinder-shaped dehumidifying rotor including: an adsorption area which adsorbs moisture from air having moisture and passing through the adsorption area, and a regeneration area from which moisture is desorbed by heated air passing through the regeneration area, where the adsorption area and the regeneration area alternate with each other continually by rotation of the dehumidifying rotor.

In one embodiment, two parts of two-bed switching type dehumidifying parts, and two switch valves, where two parts of two-bed switching type dehumidifying parts may operate for dehumidification and for regeneration alternately, by switch valves converting direction of air flow.

In one embodiment, the porous organic-inorganic hybrid materials may adsorb at least about 0.1 g of moisture per 1 g of the porous organic-inorganic hybrid materials.

In one embodiment, the porous organic-inorganic hybrid materials include at least one metal component selected from the group consisting of Sc, Y, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, Mg, Ca, Sr, Ba, Al, Ga, In, Tl, Si, Ge, Sn, Pb, As, Sb and Bi.

In one embodiment, the porous organic-inorganic hybrid materials include at least one metal component selected from the group consisting of Ag(I), Cu(II or I) and Ni(II), having antibacterial activity.

In one embodiment, the porous organic-inorganic hybrid materials include copper terephthalate, iron terephthalate, manganese terephthalate, chromium terephthalate, vanadium terephthalate, aluminum terephthalate, titanium terephthalate, zirconium terephthalate, magnesium terephthalate, copper benzenetricarboxylate, iron benzenetricarboxylate, manganese benzenetricarboxylate, chromium benzenetricarboxylate, vanadium benzenetricarboxylate, aluminum benzenetricarboxylate, titanium benzenetricarboxylate, zirconium benzenetricarboxylate, magnesium benzenetricarboxylate, iron naphthalenedicarboxylate, chromium naphthalenedicarboxylate, aluminum naphthalenedicarboxylate, nickel dihydroxyterephthalate, cobalt dihydroxyterephthalate, magnesium dihydroxyterephthalate, manganese dihydroxyterephthalate, iron dihydroxyterephthalate, iron benzenetribenzoate, chromium benzenetribenzoate, aluminum benzenetribenzoate, titanium benzenetribenzoate, a derivative thereof, a solvate thereof, a hydrate thereof or a combination of any two or more thereof.

In one embodiment, the porous organic-inorganic hybrid materials are at least one compound represented by the following formula or at least one hydrate thereof:

$M_3X(H_2O)_2O[C_6Z_{4-y}Z'_y(CO_2)_2]_3$(M=Cu, Fe, Mn, Cr, V, Al, Ti, Zr or Mg; X=Cl, Br, I, F or OH; Z or Z'=H, $NH_2$, Br, I, $NO_2$ or OH; $0 \leq y \leq 4$);

$M_3O(H_2O)_2X[C_6Z_{3-y}Z'_y—(CO_2)_3]_2$(M=Cu, Fe, Mn, Cr, V, Al, Ti, Zr or Mg; X=Cl, Br, I, F or OH; Z or Z'=H, $NH_2$, Br, I, $NO_2$ or OH; $0 \leq y \leq 3$);

$M_3O(H_2O)_2X_{1-y}(OH)_y[C_6H_3—(CO_2)_3]_2$($0 \leq y \leq 1$; M=Cu, Fe, Mn, Cr, V, Al, Ti, Zr or Mg; X=Cl, Br, I or F); or $M_3X_{1-y}(OH)_y(H_2O)_2O[C_6H_4(CO_2)_2]_3$($0 \leq y \leq 1$; M=Cu, Fe, Mn, Cr, V, Al, Ti, Zr or Mg; X=Cl, Br, I or F).

In one embodiment, the porous organic-inorganic hybrid materials are at least one compound represented by the following formula or at least one hydrate thereof:

$M_6O_4(OH)_4[C_6Z_{4-y}Z'_y(CO_2)_2]_{12}$(M=Ti, Sn or Zr; Z or Z'=H, $NH_2$, Br, I, $NO_2$ or OH; $0 \leq y \leq 4$); or $M_2(dhtp)(H_2O)_2$(M=Ni, Co, Mg, Mn and Fe; *dhtp*=2, 5-dihydroxyterephthalic acid).

In one embodiment, the organic ligand is a compound having at least one functional group selected from the group consisting of carbonic acid group (—$CO_3H$), anion group of carbonic acid (—$CO_3^-$), carboxyl group, anion group of carboxylic acid, amino group (—$NH_2$), imino group

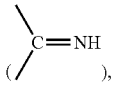

amide group (—$CONH_2$), sulfonic acid group (—$SO_3H$), anion group of sulfonic acid (—$SO_3^-$), methanedithioic acid group (—$CS_2H$), anion group of methanedithioic acid (—$CS_2^-$), pyridine group and pyrazine group, or a mixture thereof.

In one embodiment, the porous organic-inorganic hybrid materials have an unsaturated metal site, and a surface-functionalizing compound is bound to the unsaturated metal site.

In one embodiment, the porous organic-inorganic hybrid materials are prepared in a form of powder, thin film, membrane, pellet, ball, foam, slurry, paste, paint, honeycomb, bead, mesh, fiber, corrugated sheet or rotor.

In one embodiment, the dehumidifying part further includes at least one metal catalyst selected from the group consisting of platinum, silver, gold, palladium, ruthenium, rhodium, osmium, iridium, manganese, copper, cobalt, chromium, nickel, iron, zinc and a combination of any two or more thereof.

In one embodiment, the apparatus for treating air is capable of eliminating hydrocarbon, NOx, CO or volatile organic compound included in the air received from outside.

In one embodiment, the dehumidifying part further includes at least one dehumidifying agent selected from the group consisting of zeolite, activated alumina, lithium chloride, activated carbon, aluminum silicate, calcium chloride and calcium carbonate.

In one embodiment, a cylinder-shaped dehumidifying rotor including an adsorption area which adsorbs moisture from air having moisture and passing through the adsorption area, and a regeneration area from which moisture is desorbed by heated air passing through the regeneration area causes the adsorption area and the regeneration area alternate with each other continually by rotation of the dehumidifying rotor, and includes porous organic-inorganic hybrid materials formed by binding a central metal ion with an organic ligand as an adsorbent.

In one embodiment, an apparatus for treating air includes: two adsorbing parts including an adsorbent, capable of adsorbing or desorbing a refrigerant alternatively; a condenser capable of condensing the refrigerant desorbed from the adsorbing part; an evaporator capable of providing cooling effect by evaporating the refrigerant; a refrigerant passage linking the adsorbing part, the condenser and the evaporator, where the refrigerant flows in the refrigerant passage; and flow control valves placed in the refrigerant passage, where the condenser and the evaporator are placed between the two adsorbing parts, and the adsorbent includes porous organic-inorganic hybrid materials formed by binding a central metal ion with an organic ligand.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
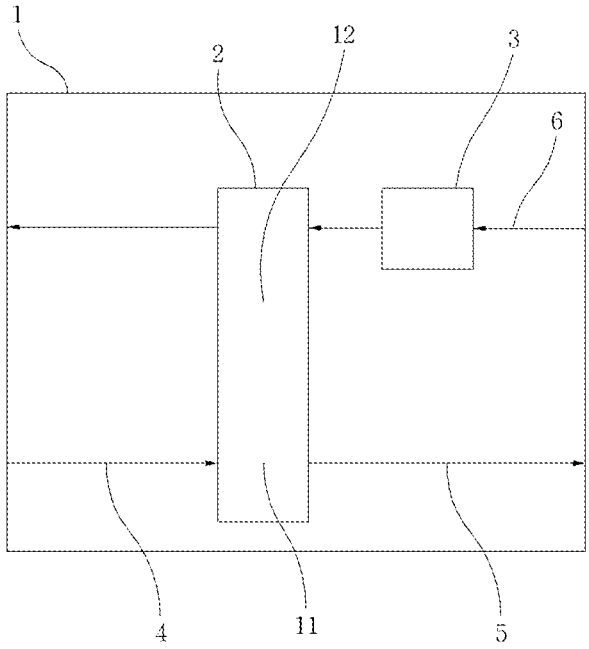
FIG. 1 is a schematic drawing of an apparatus for treating air according to one illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the components of the present disclosure, as generally described herein, and illustrated in the Figures, may be arranged, substituted, combined, and designed in a wide variety of different configurations, all of which are explicitly contemplated and make part of this disclosure.

FIG. 1 is a schematic drawing of an apparatus for treating air according to one illustrative embodiment.

In one embodiment, an apparatus for treating air includes a case (1) for forming the outside, a dehumidifying part (2) placed in the case (1) including an adsorbent, an inlet passage (4) for providing air having moisture to the dehumidifying part (2) from outside, and an outlet passage (5) for discharging dehumidified air by the dehumidifying part (2).

In one embodiment, a regeneration passage (6) for receiving air outside the apparatus for treating air and/or circulating air in the apparatus for treating air is placed inside the case (1) of the apparatus for treating air in order to regenerate the adsorbent of the dehumidifying part (2) to which moisture was adsorbed, and a heating part (3) is placed on the regeneration passage (6). In one embodiment, the heating part (3) can mean any heating source providing heat to the air passing through the regeneration passage (6). The heating part (3) may heat the air passing through the regeneration passage (6) by directly delivering heat energy, or may heat the air passing through the regeneration passage (6) by providing air of high temperature heated outside the apparatus for treating air, but not limited to a specific method. In one embodiment, the heating part (3) may include any conventional heating device such as the heating coil.

In some embodiments, a ventilation fan (not illustrated) may be placed in the inlet passage (4), outlet passage (5) and/or regeneration passage (6) in order to proceed air in the direction illustrated in FIG. 1. In another embodiment, an air filter (not illustrated) may be further placed at the dehumidifying part (2) and/or heating part (3) in order to eliminate dirt, dust, etc. included in the air.

Figure 2:
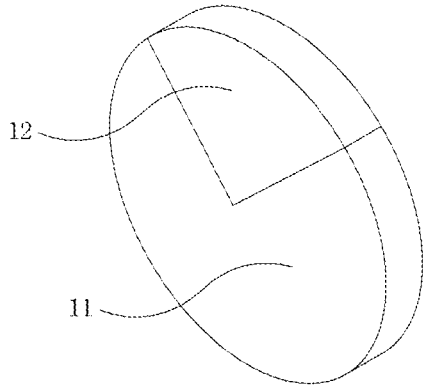
FIG. 2 is a schematic drawing of a dehumidifying part according to one illustrative embodiment.

In one embodiment, as illustrated in FIG. 2, the dehumidifying part (2) may include a cylinder-shaped dehumidifying rotor, and the dehumidifying rotor is placed to rotate in a certain velocity with respect to the central axis (A). The dehumidifying part (2) including a dehumidifying rotor includes an adsorption area (11) through which air received from the inlet passage (4) passes, and a regeneration area (12) through which air received from the regeneration passage passes. In one embodiment, the position of the adsorption area (11) and regeneration area (12) is relatively determined with respect to the position of the inlet passage (4) and regeneration passage (6). Thus, the position of the adsorption area (11) and regeneration area (12) in the dehumidifying rotor alternate with each other continually by rotation of the driving motor (not illustrated) connected to the dehumidifying rotor. For example, by rotation of the dehumidifying rotor, part of the dehumidifying rotor which used to be an adsorption area (11) becomes a regeneration area (12), and part of the dehumidifying rotor which used to be a regeneration area (12) becomes an adsorption area (11). Such process is repeated continually. In some embodiments, the area ratio of the adsorption area (11) and regeneration area (12) with respect to the total area of the dehumidifying rotor may be suitably determined depending on the dehumidifying amount and regeneration efficiency. In some embodiments, the apparatus for treating air may include at least two dehumidifying rotors connected in series and/or in parallel, as needed. In case the dehumidifying part (2) includes two or more dehumidifying rotors, the dehumidifying efficiency per volume of dehumidifying part may increase.

With regard to the operation of the apparatus for treating air according to one embodiment, air received from outside through the inlet passage (4) is provided to the adsorption area (11) of the dehumidifying part (2), and air is dehumidified by the adsorbent within the adsorption area (11). Air dehumidified by passing through the adsorption area (11) of the dehumidifying part (2) is discharged outside through the outlet passage (5). The adsorption area (11) of the dehumidifying part (2) to which moisture was adsorbed moves to the area bordering the regeneration passage (6) by the rotation of the dehumidifying part (2) and becomes the regeneration area (12). Next, after the air moving through the regeneration passage (6) (air outside the apparatus for treating air and/or circulating air in the apparatus for treating air) is heated by the heating part (3), it passes through the regeneration area (12) of the dehumidifying part (2). As the heated air contacts the adsorbent of the regeneration area (12) to which moisture was adsorbed, the moisture adsorbed is desorbed. In one embodiment, by rotation of the dehumidifying part (2), moisture adsorbed at the adsorption area (11) is removed at the regeneration area (12), and air is dehumidified by the adsorbent regenerated in the regeneration area (12) at the adsorption area (11). Accordingly, air is dehumidified continually, and dehumidified air can be provided.

In one embodiment, some of the air provided to the inlet passage (4) and/or regeneration passage (6) by-passes without passing through the dehumidifying part (2) and meets with other air passing through the dehumidifying part (2). In another embodiment, some of the air provided to the inlet passage (4) passes through the fuzzy area (not illustrated) designated as the part of the dehumidifying rotor converting from regeneration area (12) to adsorption area (11) and vice versa, thus lowering the temperature of the part of the dehumidifying rotor moving to the adsorption area (11), and the air is provided to the heating part (3). In case of placing a fuzzy area between the adsorption area (11) and regeneration area (12), it becomes possible to inhibit the movement of sensible heat and adsorb moisture at lower temperatures, thus increasing the adsorption efficiency at the adsorption area (12).

Figure 3:
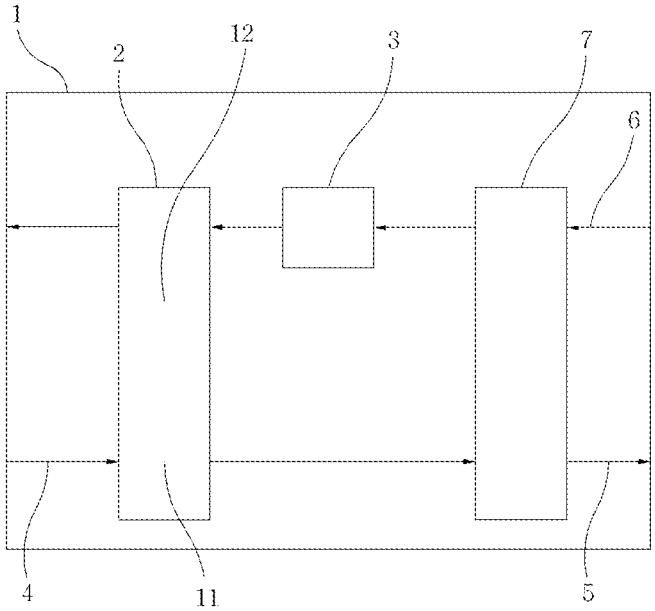
FIG. 3 is a schematic drawing of an apparatus for treating air according to one illustrative embodiment.

FIG. 3 is a schematic drawing of the apparatus for treating air further including a heat exchanger (7) according to one illustrative embodiment. The apparatus for treating air illustrated in FIG. 3 is the same as the apparatus for treating air according to FIG. 1 except that it further includes a heat exchanger (7) for exchanging heat between the air in the outlet passage (5) and the air in the regeneration passage (6). Thus, explanation on the constitution that overlaps with that of FIG. 1 is omitted.

In one embodiment, the process where moisture is adsorbed to the adsorbent of the dehumidifying part (2) in the dehumidifying step is an exothermic process generating diluted heat. In contrast, the process where moisture is desorbed from the adsorbent in the regenerating step is an endothermic process requiring reaction heat. The heat exchanger (7) exchanges heat between the air before passing through the heating part (3) at the regeneration passage (6) and the air after passing through the adsorption area (11) of the dehumidifying part (2). By the heat exchanger (7), air dehumidified by passing through the adsorption area (11) can be cooled and air moving through the regeneration passage (6) (air outside the apparatus for treating air and/or circulating air in the apparatus for treating air) can be preheated (recovering heat) at the same time. In case of additionally using a heat exchanger (7), the efficiency of the energy spent for operating the apparatus for treating air can be increased.

In one embodiment, the heat exchanger (7) may include a cylinder-shaped rotating rotor having a honeycomb structure.

A plurality of passages may be formed along the axial direction of the rotating rotor, and the inner surface of the passage may be treated with a material that easily transfers heat, for example metals such as aluminum. The rotating rotor is divided into a heating area and a cooling area, and the heating area and the cooling area may alternate with each other by the rotation of the driving motor connected to the rotating rotor.

The dehumidifying operation and cooling operation of the apparatus for treating air according to one embodiment are explained hereinafter. The air (outside, high temperature) received from the inlet passage (4) is dehumidified by passing through the adsorption area (11) of the dehumidifying part (2), and temperature may increase a little by the adsorption heat. Dry air is cooled after passing through the heat exchanger (7) (e.g., cooling area of the rotating rotor), and the dry air is provided indoor through the outlet passage (5). Meanwhile, air (indoor, low temperature) received from the regeneration passage (6) is heated after passing through the heat exchanger (7) (e.g., heating area of the rotating rotor). After being heated by the heating part (3), the heated air passes through the regeneration area (12) of the dehumidifying part (2). As the heated air contacts the adsorbent of the regeneration area (12) to which moisture is adsorbed, the adsorbed moisture is desorbed. In the apparatus for treating air as above, latent heat load is treated by the dehumidifying part (2) and sensible heat load is treated by the heat exchanger (7). Thus, the apparatus has an energy efficiency greater than that of the condensing type cooling apparatus. Also, air can be dehumidified and cooled efficiently at the same time.

Figure 4:
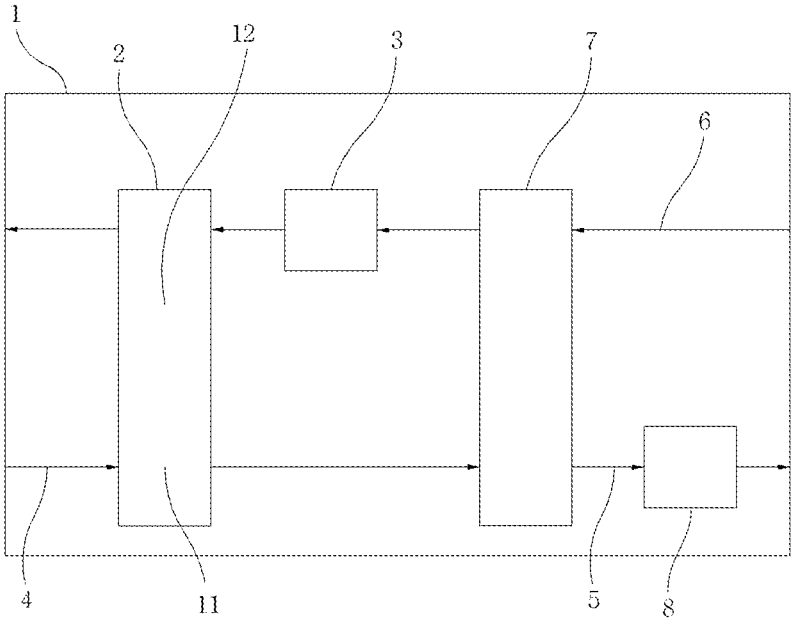
FIG. 4 is a schematic drawing of an apparatus for treating air according to one illustrative embodiment.

FIG. 4 is a schematic drawing of the apparatus for treating air further including a cooling part (8) according to one illustrative embodiment. The apparatus for treating air illustrated in FIG. 4 is the same as the apparatus for treating air according to FIG. 3 except that a cooling part (8) is further placed in the outlet passage (5). Thus, explanation on the constitution that overlaps with that of FIG. 3 is omitted.

In one embodiment, the cooling part (8) may include an conventional cooling coil, a condensing type cooling apparatus, an evaporating type cooling apparatus, a combination of any two or more thereof, but it is not limited to a specific cooling method. The temperature of the air dehumidified by the dehumidifying part (2) and cooled by the heat exchanger (7) gets lower by passing through the cooling part (8). Latent heat load may be treated by the dehumidifying part (2) and sensible heat load may be treated by the cooling part (8). Thus, the humidity and temperature of the air provided can be controlled independently.

Figure 5:
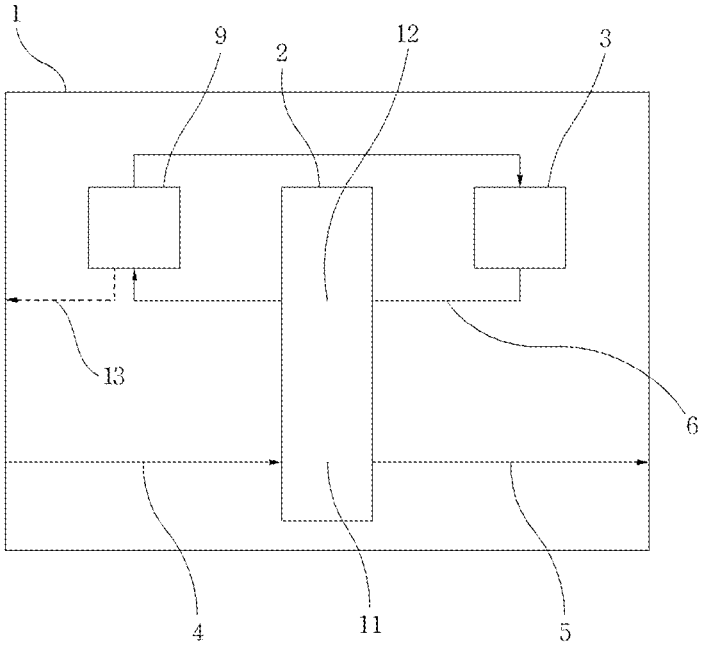
FIG. 5 is a schematic drawing of an apparatus for treating air according to one illustrative embodiment.

FIG. 5 is a schematic drawing of the apparatus for treating air according to one illustrative embodiment. In the embodiment, the apparatus for treating air is the same as the apparatus for treating air according to FIG. 1 except that the regeneration passage (6) is placed to circulate the heating part (3), the adsorption area (11) of the dehumidifying part (2) and the condenser (9). Thus, explanation on the constitution that overlaps with that of FIG. 1 is omitted.

In one embodiment, moisture included in the air that passed through the regeneration area (12) of the dehumidifying part (2) is liquefied to water at the condenser (9), and the liquefied water is discharged outside or to a separate storing part through a drainage (13). Air dehumidified by the condenser (9) moves to the heating part (3) again. In one embodiment, some of the air circulating the regeneration passage (6) may be discharged outside through a suitable means, and some of the air received to the apparatus for treating air from outside may be included in the circulated air of the regeneration passage (6). In one embodiment, the apparatus for treating air may further include a heat exchanger (7) at the outlet passage (5) and regeneration passage (6) and/or a cooling part (8) at the outlet passage (5) (not illustrated).

Figure 6:
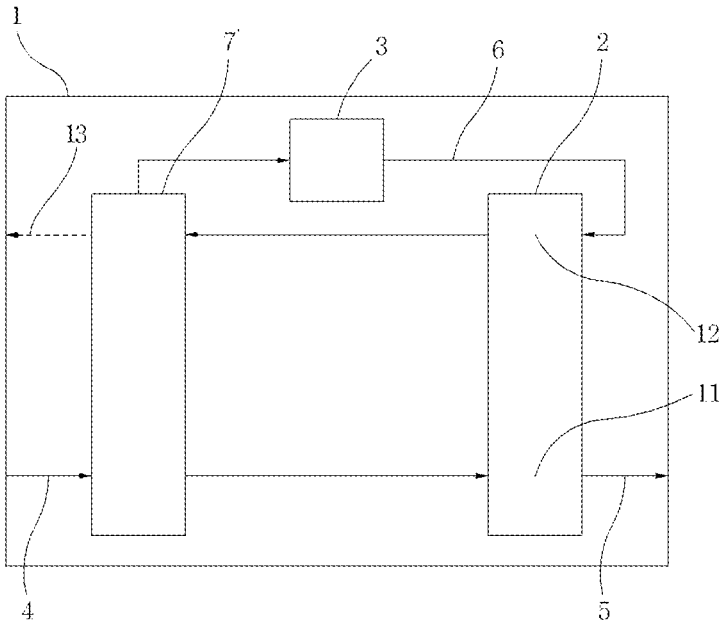
FIG. 6 is a schematic drawing of an apparatus for treating air according to one illustrative embodiment.

FIG. 6 is a schematic drawing of the apparatus for treating air according to one illustrative embodiment. In the present embodiment, the apparatus for treating air is the same as the apparatus for treating air according to FIG. 1 except that a regeneration passage (6) is placed to circulate the heating part (3), the adsorption area (11) of the dehumidifying part (2) and the heat exchanger (7'). Thus, explanation on the constitution that overlaps with that of FIG. 1 is omitted.

In one embodiment, the air of the inlet passage (4) passes through the heat exchanger (7') before being provided to the dehumidifying part (2). The air of the regeneration passage (6) passes through the regeneration area (12) of the dehumidifying part (2), and then passes through the heat exchanger (7') before being provided to the heating part (3) again. The heat exchanger (7') exchanges heat between the air in the regeneration passage (6) of which moisture is adsorbed at the dehumidifying part (2) and the air in the inlet passage (4) provided from outside. Moisture included in the air that passed through the regeneration area (12) of the dehumidifying part (2) is liquefied to water at the heat exchanger (7'), and the liquefied water is discharged outside or to a separate storing part through a drainage (13). Air dehumidified at the heat exchanger (7') moves to the heating part (3) again. In one embodiment, some of the air circulating the regeneration passage (6) may be discharged outside through a suitable means, and some of the air received to the apparatus for treating air from outside may be included in the circulated air of regeneration passage (6). In one embodiment, the apparatus for treating air may further include a heat exchanger (7) at the outlet passage (5) and regeneration passage (6) and/or further include a cooling part (8) at the outlet passage (5) (not illustrated).

In one embodiment, the apparatus for treating air including a dehumidifying part (2) can be classified into outside-air type unit, inside-circulation type unit or mixed outside-air type unit depending on how air is received from outside. The outside-air type can be used when there is dust in the subject area for treating air and it is difficult to recirculate dry air. The inside-circulation type can be used for places where it is not necessary to receive air from outside such as a storehouse, or an indoor room where outside unit is not installed. The mixed outside-air type is a method used by mixing return air, which can be used when controlling temperature and moisture at high level is required.

Figure 7:
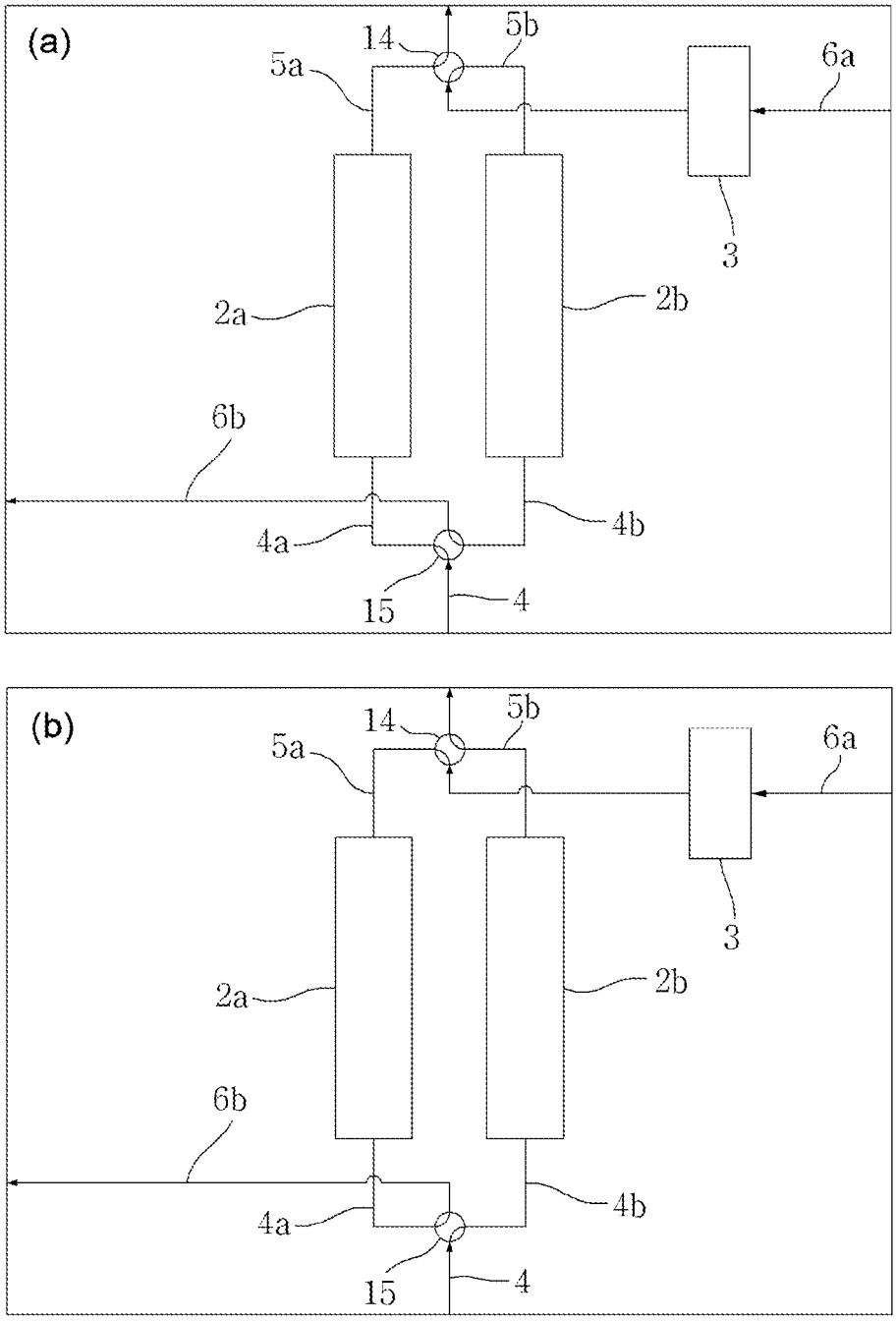
FIG. 7 is a schematic drawing of an apparatus for treating air according to one illustrative embodiment.

FIG. 7 is a schematic drawing of the apparatus for treating air according to one illustrative embodiment. The apparatus for treating air according to the present embodiment has two parts of two-bed switching type dehumidifying parts. As illustrated in FIGS. 7*a* & 7*b*, the two-bed switching type apparatus for treating air includes two parts of dehumidifying parts (2*a*, 2*b*) and two switch valves (14, 15). Also, the two parts of dehumidifying parts (2*a*, 2*b*) may operate for dehumidification and for regeneration alternately by switch valves (14, 15) converting direction of air flow.

In particular, in FIG. 7*a*, switch valve (15) provides wet air received from the inlet passage (4) to the dehumidifying part (2*b*) through a pathway (4*b*), so that dehumidification is performed at the dehumidifying part (2*b*) and dehumidified air is discharged through the pathway (5*b*) and switch valve (14). Also, after air dried for regeneration is received from a pathway (6*a*) and heated by the heating part (3), it is provided to the switch valve (14) and the switch valve (14) provides the heated air to the dehumidifying part (2*a*) through the pathway (5*a*) to perform regeneration at the dehumidifying part (2*a*).

Air having moisture from the dehumidifying part (2*a*) is discharged outside through a pathway (6*b*) after passing through the pathway (4*a*) and switch valve (15).

By such operation, when the adsorbent of the dehumidifying part (2*b*) is almost saturated and requires regeneration, the switch valves (14, 15) convert direction of air flow of the wet air and the air to be regenerated. In particular, as illustrated in FIG. 7*b*, wet air received from the inlet passage (4) is sent to the pathway (4*a*) by the switch valve (15), thus being provided to the dehumidifying part (2*a*) where regeneration is completed, and the air for regeneration received from the pathway (6*a*) is sent to the pathway (5*b*) by the switch valve (14), thus being provided to the dehumidifying part (2*b*) requiring regeneration. Thus, air dried by the dehumidifying part (2*a*) is discharged through the pathway (5*a*) and switch valve (14), and air having moisture from the dehumidifying part (2*b*) is discharged outside through the pathways (4*b*) and (6*b*).

As above, two parts of dehumidifying parts (2*a*, 2*b*) can be operated continually for adsorption or desorption by switch valves (14, 15) converting direction of airflow.

Figure 8:
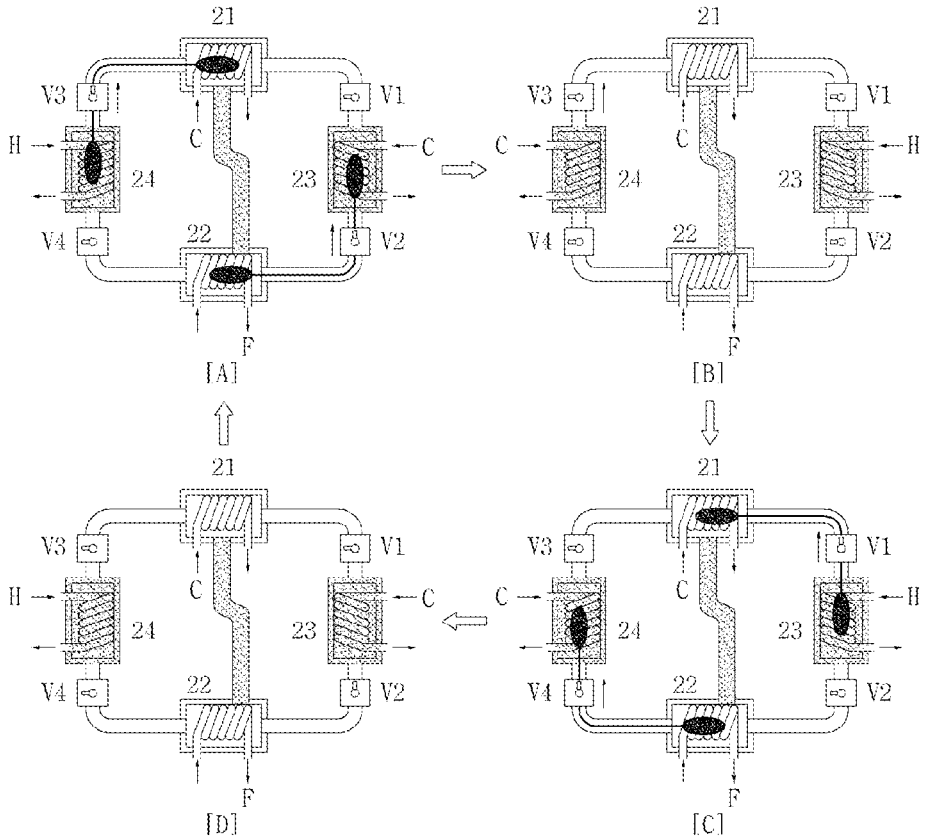
FIG. 8 is a schematic drawing of an apparatus for treating air according to one illustrative embodiment.

FIG. 8 is a schematic drawing of the apparatus for treating air according to one illustrative embodiment. The apparatus for treating air according to one embodiment includes two adsorbing parts (23, 24) including adsorbent capable of adsorbing or desorbing a refrigerant alternately; a condenser (21) capable of condensing the refrigerant desorbed at the adsorbing part; an evaporator (22) capable of providing a cooling effect outside by evaporating the refrigerant; a refrigerant passage connecting the adsorbing part (21), condenser (21) and evaporator (22) and enabling the refrigerant to flow; and four flow control valves (V1, V2, V3, V4) placed on the refrigerant passage, where the evaporator and the condenser are placed respectively between the two adsorbing parts (23, 24).

As illustrated in FIG. 8, among the four flow control valves, the valve (V1) is placed between the condenser (21) and adsorbing part (23), the valve (V2) is placed between the adsorbing part (23) and evaporator (22), the valve (V3) is placed between the evaporator (22) and adsorbing part (24), and the valve (V4) is placed between the adsorbing part (24) and condenser (21). The flow direction in the refrigerant passage is determined depending on whether the valves (V1, V2, V3, V4) are open or closed.

In one embodiment, the flow of the refrigerant in the refrigerant passage may be accomplished by the pressure difference between each constitutional element, and a predetermined pump (not illustrated) may be placed on the refrigerant passage in order to facilitate the flow.

In one embodiment, the apparatus for treating air may include a predetermined controller (not illustrated). The controller may control the flow direction of the refrigerant by controlling the operation of the adsorbing parts (23, 24), condenser (21), etc., and the opening and closing of the evaporator (22), valves (V1, V2, V3, V4).

In one embodiment, a refrigerant capable of discharging heat when being adsorbed to the adsorbing part (23, 24) or condensed at the condenser (21), and capable of absorbing heat when being desorbed from the adsorbing part (23, 24) or evaporated at the evaporator (21) may be used. As a refrigerant, in terms of cost, environment, etc., water can be used, but the refrigerant is not limited thereto, and alcohol (e.g., methanol, ethanol), ammonia, etc. can be used.

Referring to FIG. 8, the detailed operation of the apparatus for treating air following operation modes [A]~[D] is explained hereinafter. The apparatus for treating air according to the present embodiment operates with closed refrigerant passage where refrigerant circulate (closed cycle). In some embodiments, the apparatus for treating air operates in a vacuum or a condition close to a vacuum, thus reducing diffusion resistance of the refrigerant. With regard to the open and closed mode of the valves (V1, V2, V3, V4) and the operation method of the adsorbing parts (23, 24) according to the operation modes [A]~[D], refer to the following Table 1.

TABLE 1

| Operation Mode | | [A] | [B] | [C] | [D] |
|---|---|---|---|---|---|
| Valve | V1 | X | X | O | X |
| | V2 | O | X | X | X |
| | V3 | O | X | X | X |
| | V4 | X | X | O | X |
| Adsorbing part | 23 | Cooling | Heating | Heating | Cooling |
| | 24 | Heating | Cooling | Cooling | Heating |

O: Open
X: Closed

In operation mode [A], valves (V2) and (V3) are open and valves (V1) and (V4) are closed. Heat is provided from any heating source to the adsorbing part (24) (e.g., heating fluid (H) such as hot water is provided), and the refrigerant adsorbed to the adsorbing part (24) is desorbed. Heat is eliminated from the adsorbing part (23) by any cooling means (e.g., cooling fluid (C) such as cooling water is provided), and the refrigerant received is adsorbed at the adsorbing part (23). Heat is eliminated from the condenser (21) by any cooling means (e.g., cooling fluid (C) such as cooling water is provided), and the refrigerant desorbed from the adsorbing part (24) is condensed at the condenser (21). As the refrigerant condensed evaporates at the evaporator (22), heat is absorbed, and a cooling effect can be achieved. By such cooling effect, a chilled fluid F (e.g., chilled water) can be obtained, and this can be provided to a desired place for cooling.

If desorption is proceeded at the adsorbing part (24) and absorption is proceeded at the adsorbing part (23) to reach or be close to an equilibrium condition, the absorption/desorption operation at the adsorbing part (24) and adsorbing part (23) alternate with each other. As a preliminary process for such alternation, in operation mode [B], after stopping the movement of heat and substances by absorption and desorption by closing all valves (V1, V2, V3 and V4), heat is provided to the adsorbing part (24) and then heat is eliminated from the adsorbing part (23).

In operation mode [C], valves (V1) and (V4) are open and valves (V2) and (V3) are closed. Except that heat is eliminated from and the refrigerant is adsorbed to the adsorbing part (24), and heat is provided to and the refrigerant is desorbed from the adsorbing part (23), a cooling effect similar to that obtained in operation mode [A] can be obtained by the evaporator (22).

In a manner similar to operation mode [B], after preparing for the alternation of absorption and desorption by closing all valves (V1, V2, V3 and V4) in operation mode [D], operation mode [A] is performed again.

As such, a cooling effect can be provided continually by evaporation by operation of absorption and desorption alternately at the adsorbing part (24) and adsorbing part (23).

Such adsorption type apparatus for treating air has advantages such that it causes less vibration and noise by having smaller driving parts, it provides a cooling effect without using a Freon type refrigerant which damages the ozone layer, it has high stability when using water as a refrigerant (in terms of toxicity, abrasion, combustability, etc.), it does not have the disadvantage of solution crystallization as the absorbing type, and it has a lower possibility for non-condensed gas (hydrogen, etc.) to be generated (no additional operation is required, and it is advantageous in maintaining a vacuum). Also, the adsorbent including porous organic-inorganic hybrid materials of the adsorbing parts (23) and (24) can desorb the refrigerant at relatively low temperature, and thus waste heat of low temperature (e.g., about 50~90° C.) can be used as a heating source of the adsorbing part (23, 24) for desorption. The heating source may be originated from heat discharged from cooling water or apparatus during various manufacturing processes, heat originated from engine or generator of transportation means such as vessel, train or automobile, or the like, but is not limited thereto.

Figure 9:
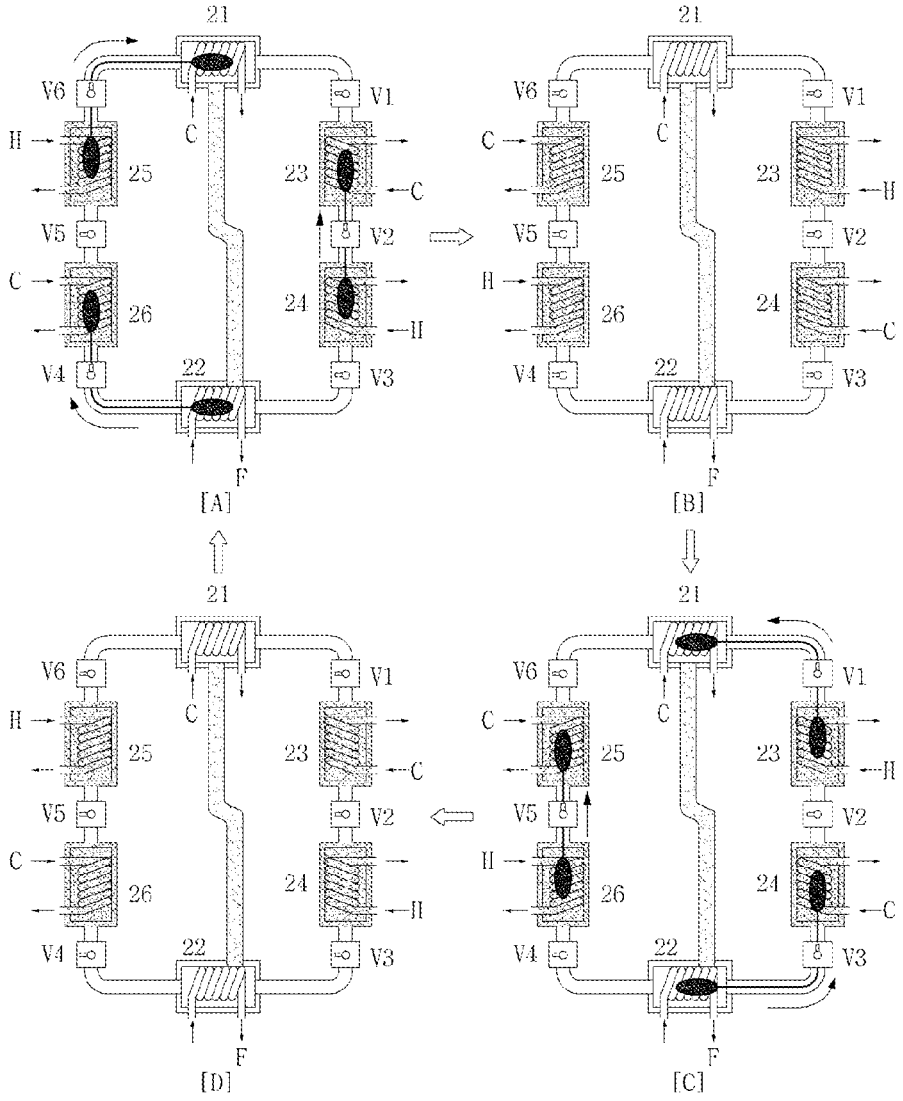
FIG. 9 is a schematic drawing of an apparatus for treating air according to one illustrative embodiment.

FIG. 9 is a schematic drawing of the apparatus for treating air according to one illustrative embodiment. The apparatus for treating air according to the present embodiment is a two-stage type (four-bed) apparatus for treating air. As illustrated in FIG. 9, except that the apparatus includes adsorbing parts (23, 24, 25 and 26) and valves (V1, V2, V3, V4, V5 and V6), it is similar to the apparatus for treating air according to FIG. 8. As illustrated, a cooling effect can be provided continually by evaporation by operation of absorption and desorption alternately at the adsorbing parts (23, 24, 25 and 26). Explanation on the constitution that overlaps with that of FIG. 8 is omitted.

Figure 10:
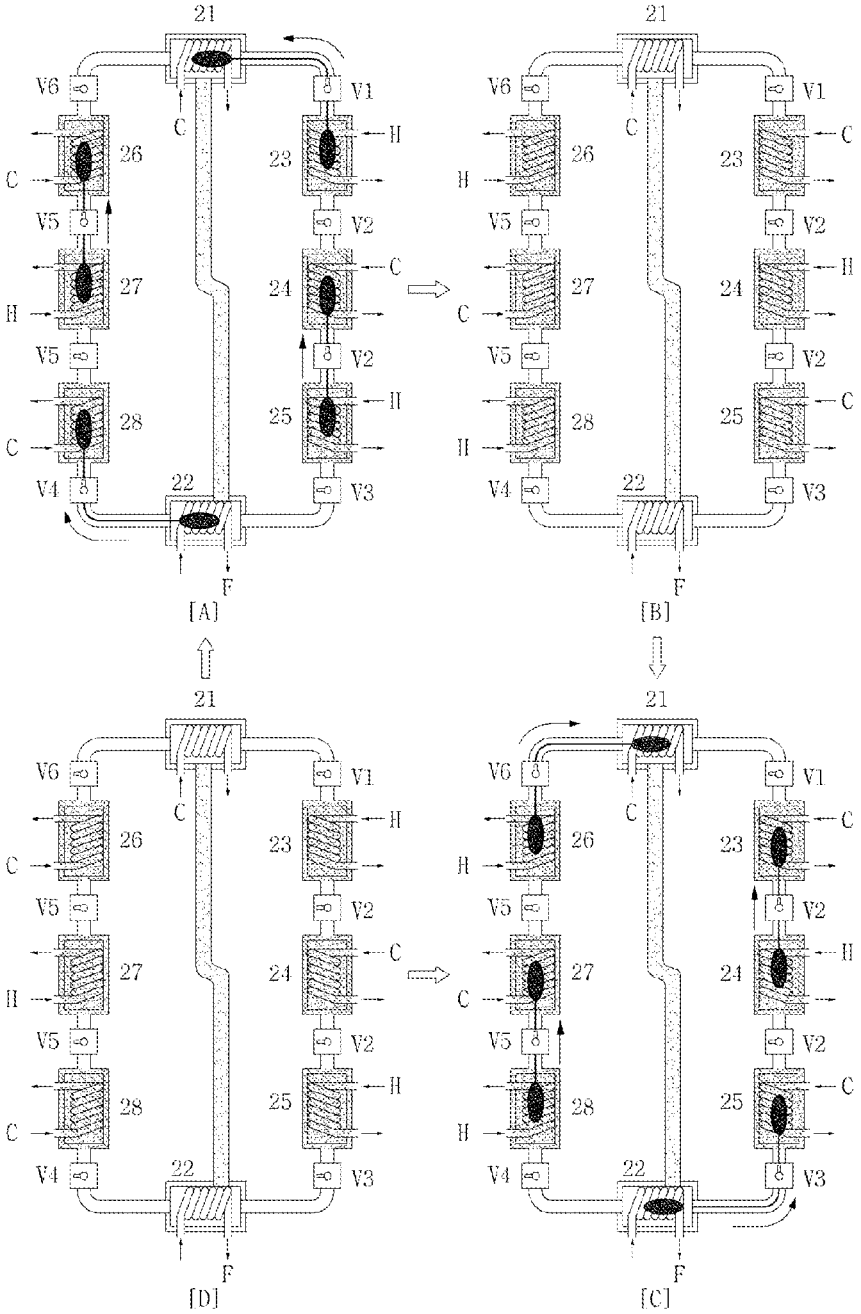
FIG. 10 is a schematic drawing of an apparatus for treating air according to one illustrative embodiment.

FIG. 10 is a schematic drawing of the apparatus for treating air according to one illustrative embodiment. The apparatus for treating air according to the present embodiment is a three-stage type (six-bed) apparatus for treating air. As illustrated in FIG. 9, except that the apparatus includes adsorbing parts (23, 24, 25, 26, 27 and 28) and valves (V1, V2, V3, V4, V5, V6, V7 and V8), it is similar to the apparatus for treating air according to FIG. 8. As illustrated, a cooling effect can be provided continually by evaporation by operation of absorption and desorption alternately at the adsorbing parts (23, 24, 25, 26, 27 and 28). Explanation on the constitution that overlaps with that of FIG. 8 is omitted.

In one embodiment, in a multi-stage type apparatus for treating air such as two-stage type system, three-stage type system, even when the temperature of the heating source of the adsorbing part is even lower (e.g., 40~50° C.), a cooling effect can be obtained. Thus, waste heat of low temperature discarded considerably can be recovered to be used.

Figure 11:
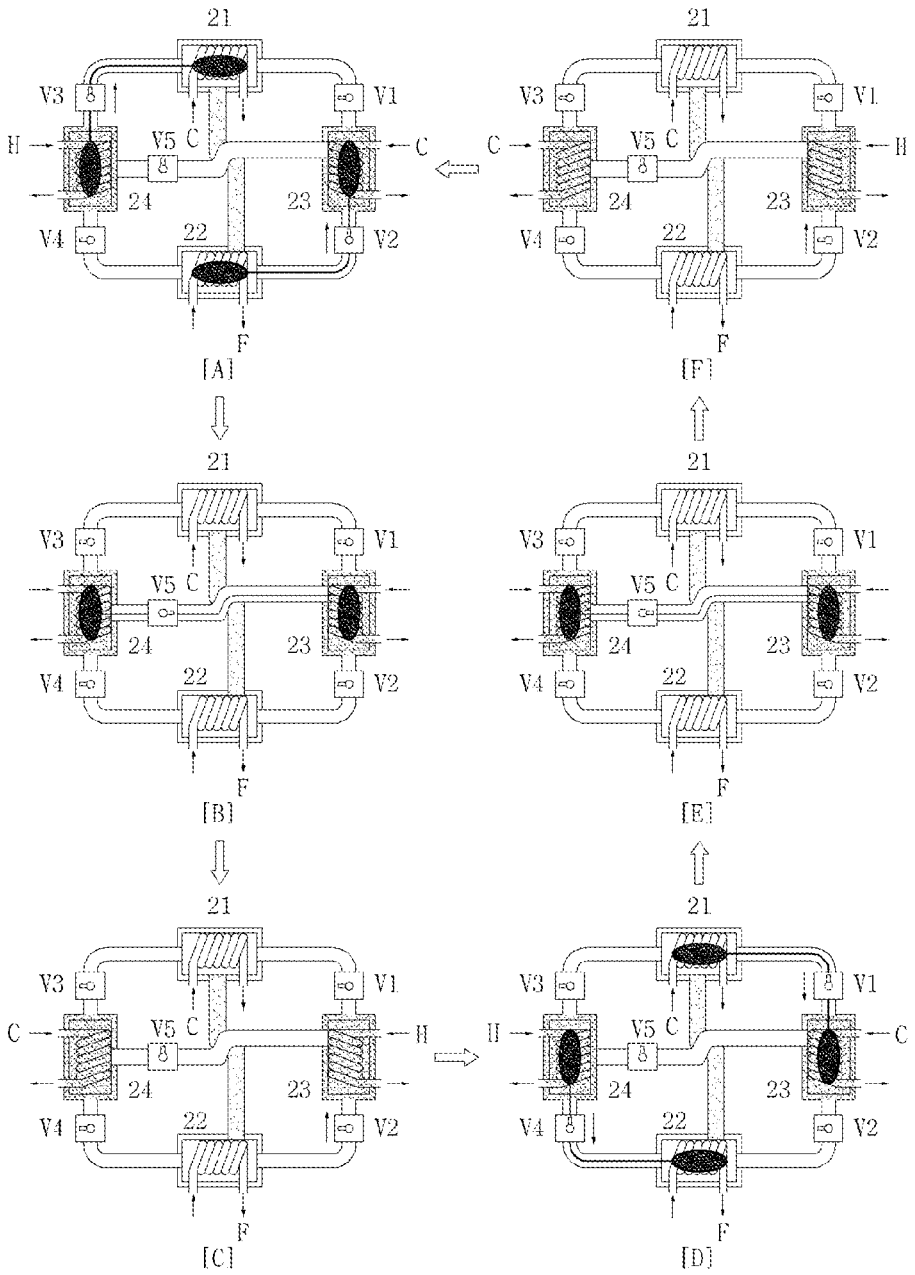
FIG. 11 is a schematic drawing of an apparatus for treating air according to one illustrative embodiment.

FIG. 11 is a schematic drawing of the apparatus for treating air according to one illustrative embodiment. The apparatus for treating air according to the present embodiment is similar to the apparatus for treating air according to FIG. 8 except for further including a refrigerant passage and valve (V5) connecting the adsorbing part (23) and adsorbing part (24). The cooling capability may be improved by using the pressure difference within adsorbing part (23) and adsorbing part (24). The adsorption amount and desorption amount increase by heat-exchanging the latent heat of refrigerant vapor by controlling the valve (V5) between adsorbing part (23) and adsorbing part (24), and the cooling capability increases as the concentration difference increases during adsorption and desorption at the adsorbing part. In such embodiment, the valve (V5) is open so that latent heat of the refrigerant vapor can be exchanged between adsorbing part (23) and adsorbing part (24), as in operation modes [B] and [E].

In one embodiment, a booster pump or compressor may be further placed between the adsorbing part and condenser (21). In such embodiment, refrigerant vapor desorbed from the adsorbing part is compressed at high pressure, thus condensing the refrigerant at normal ambient temperature without eliminating heat from the condenser (21) using a separate cooling means.

In one embodiment, a water adsorbent can be used as an adsorbent at the dehumidifying parts (2), (2*a*) and (2*b*), and adsorbing parts (23), (24), (25), (26), (27) and (28). The adsorbent may include porous organic-inorganic polymer compounds (or porous organic-inorganic hybrid materials) formed by binding a central metal ion with an organic ligand. The porous organic-inorganic hybrid materials may be crystalline compounds with pores of a molecular size or nano size including both an organic material and an inorganic material within the framework structure. The porous organic-inorganic hybrid materials is also referred to as porous coordination polymers [Angew. Chem. Intl. Ed., 43, 2334, 2004], or metal-organic frameworks (MOF) [Chem. Soc. Rev., 32, 276, 2003].

In another embodiment, the adsorbent may further include a dehumidifying agent such as silica gel, zeolite, activated alumina, lithium chloride, activated carbon, aluminum silicate, calcium chloride and calcium carbonate, etc., and if necessary, at least one or two of them may be mixed with the porous organic-inorganic hybrid materials and used as an adsorbent.

In one embodiment, the porous organic-inorganic hybrid materials have pores of a molecular size or nano size. In one embodiment, the pore size of the porous organic-inorganic hybrid materials may be about 0.3~about 10 nm. In one embodiment, the average particle size of porous organic-inorganic hybrid materials is about 100 μm or less.

In one embodiment, the larger the surface area and/or pore volume of the porous organic-inorganic hybrid materials, the better the adsorption efficiency is. In one embodiment, the surface area of the porous organic-inorganic hybrid materials may be at least 300 $m^2/g$. In another embodiment, the surface area of the porous organic-inorganic hybrid materials may be at least 500 $m^2/g$, at least 700 $m^2/g$, at least 1,000 $m^2/g$, at least 1,200 $m^2/g$, at least 1,500 $m^2/g$ or at least 1,700 $m^2/g$, but is not limited thereto. In some embodiments, the surface area of the porous organic-inorganic hybrid materials may be 10,000 $m^2/g$ or less. In one embodiment, the pore volume of the porous organic-inorganic hybrid materials may be at least 0.1 mL/g, or at least 0.4 mL/g. In another embodiment, the pore volume of the porous organic-inorganic hybrid materials may be 10 mL/g or less.

In one embodiment, the porous organic-inorganic hybrid materials may include metal components. In some embodiments, the porous organic-inorganic hybrid materials may include, for example, at least one metal component selected from the group consisting of Sc, Y, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, Mg, Ca, Sr, Ba, Al, Ga, In, Tl, Si, Ge, Sn, Pb, As, Sb and Bi. In some embodiments, the porous organic-inorganic hybrid materials may include at least one of transition metals of period 4 such as Ti, V, Cr, Mn, Fe, Co, Ni, Cu, Zn and Ga; transition metals of period 5 such as Y, Zr, Nb, Mo, Tc, Ru, Rh, Pd, Ag and Cd; and transition metals of period 6 such as Lu, Hf, Ta, W, Re, Os, Ir, Pt, Au and Hg. In one illustrative embodiment, in case the transition metals are chromium, vanadium, iron, nickel, cobalt, copper, titanium or manganese, coordination compounds are easily formed. In another embodiment, the porous organic-inorganic hybrid materials may include typical elements such as magnesium, aluminum, silicon which may form a coordination compound, or lanthanoid series metals such as cerium, yttrium, terbium, europium, lanthanum. In yet another embodiment, the porous organic-inorganic hybrid materials may be formed by coordination bonding with divalent to hexavalent metal ions. In one illustrative embodiment, the divalent metal ion may be $Ni^{2+}$, $Cu^{2+}$, $Co^{2+}$, $Mg^{2+}$, $Ca^{2+}$, $Fe^{2+}$, $Mn^{2+}$, $Zn^{2+}$, etc., and the trivalent metal ion may be $Fe^{3+}$, $Cr^{3+}$, $Al^{3+}$, $Mn^{3+}$. In yet another embodiment, the porous organic-inorganic hybrid materials may be formed by coordination bonding with tetravalent, pentavalent, or hexavalent metal ions of Zr, Ti, Sn, V, W, Mo or Nb.

In one embodiment, metal components having antibacterial activity against various bacterium can be substituted within the porous organic-inorganic hybrid materials. Examples of metal components having antibacterial activity may include Ag(I), Cu(II or I), Ni(II), but are not limited thereto.

An organic compound which may act as an organic ligand included in porous organic-inorganic hybrid materials are referred as a linker. In one embodiment, the organic ligand has an organic compound having a functional group capable of coordination. In some embodiments, examples of functional groups that can coordinate may include, but not limit to, carbonic acid group (—$CO_3H$), anion group of carbonic acid (—$CO_3^-$), carboxyl, anion group of carboxylic acid, amino group (—$NH_2$), imino group

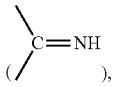

amide group (—$CONH_2$), sulfonic acid group (—$SO_3H$), anion group of sulfonic acid (—$SO_3^-$), methanedithioic acid group (—$CS_2H$), anion group of methanedithioic acid (—$CS_2^-$), pyridine group, pyrazine group, etc.

In one embodiment, the organic ligand may include organic compounds having at least two sites for coordination, e.g. polydentate such as bidentate, tridentate, etc. The examples of the above organic ligand may be a neutral organic compound such as bipyridine, pyrazine, etc., anionic organic compounds, e.g., anions of carboxylic acid such as terephthalate, naphthalenedicarboxylate, benzenetricarboxylate, benzenetribenzoate, pyridinedicarboxylate, bipyridyldicarboxylate, etc., and cationic materials, if these have a site for coordination. In another embodiment, as for the anions of carboxylic acid, in addition to anions having aromatic rings such as terephthalate, any anions, e.g., linear carboxylic acid anions such as formate, oxalate, malonate, succinate, glutamate, hexanedioate or heptanedioate and anions having non-aromatic rings such as cyclohexyldicarboxylate can be used, but is not limited thereto.

In another embodiment, the organic ligand can be dihydroxyterephthalate, or derivatives thereof. In some illustrative embodiments, as for the organic ligand, 2,5-dihydroxyterephthalate or derivatives thereof can be included. In one embodiment, as for the derivatives of dihydroxyterephthalate, dihydroxyterephthalate having Cl, Br, I, $NO_3$, $NH_2$, COOH, $SO_3H$, etc. in its benzene ring can be used.

In one embodiment, porous organic-inorganic hybrid materials can include copper terephthalate, iron terephthalate, manganese terephthalate, chromium terephthalate, vanadium terephthalate, aluminum terephthalate, titanium terephthalate, zirconium terephthalate, magnesium terephthalate, copper benzenetricarboxylate, iron benzenetricarboxylate, manganese benzenetricarboxylate, chromium benzenetricarboxylate, vanadium benzenetricarboxylate, aluminum benzenetricarboxylate, titanium benzenetricarboxylate, zirconium benzenetricarboxylate, magnesium benzenetricarboxylate, iron naphthalenedicarboxylate, chromium naphthalenedicarboxylate, aluminum naphthalenedicarboxylate, a derivative thereof, a solvate thereof, a hydrate thereof or combinations thereof. In one embodiment, as for the derivatives of carboxylate, carboxylate having Cl, Br, I, $NO_3$, $NH_2$, COOH, $SO_3H$, etc. in its benzene ring can be used.

In another embodiment, porous organic-inorganic hybrid materials may include nickel dihydroxyterephthalate, cobalt dihydroxyterephthalate, magnesium dihydroxyterephthalate, manganese dihydroxyterephthalate, or iron dihydroxyterephthalate, a derivative thereof, a solvate thereof, a hydrate thereof or combinations thereof.

In one embodiment, crystallized porous organic-inorganic hybrid materials may include two or more ligands from terephthalate, benzenetribenzoate or benzenetricarboxylate, and metal elements.

In one embodiment, porous organic-inorganic hybrid materials may include a compound of formula $M_3X(H_2O)_2O[C_6Z_{4-y}Z'_y(CO_2)_2]_3$ (M=Cu, Fe, Mn, Cr, V, Al, Ti, Zr or Mg; X=Cl, Br, I, F or OH; Z or Z'=H, $NH_2$, Br, I, $NO_2$ or OH; $0 \le y \le 4$), or a hydrate thereof, and in another embodiment, porous organic-inorganic hybrid materials may include a compound of formula $M_3O(H_2O)_2X[C_6Z_{3-y}Z'_y—(CO_2)_3]_2$ (M=Cu, Fe, Mn, Cr, V, Al, Ti, Zr or Mg; X=Cl, Br, I, F or OH; Z or Z'=H, $NH_2$, Br, I, $NO_2$ or OH; $0 \le y \le 3$), or a hydrate thereof. In some embodiments, said a hydrate can be represented as formula $M_3X(H_2O)_2O[C_6Z_{4-y}Z'_y(CO_2)_2]_3.nH_2O$ (M=Cu, Fe, Mn, Cr, V, Al, Ti, Zr or Mg; X=Cl, Br, I, F or OH; Z or Z'=H, $NH_2$, Br, I, $NO_2$ or OH; $0 \le y \le 4$; $0.1 \le n \le 50$) or $M_3O(H_2O)_2X[C_6Z_{3-y}Z'_y—(CO_2)_3]_2.nH_2O$ (M=Cu, Fe, Mn, Cr, V, Al, Ti, Zr or Mg; X=Cl, Br, I, F or OH; Z or Z'=H, $NH_2$, Br, I, $NO_2$ or OH; $0 \le y \le 3$; $0.1 \le n \le 50$).

In another illustrative embodiment, porous organic-inorganic hybrid materials can be represented by formula $M_3O(H_2O)_2X_{1-y}(OH)_y[C_6H_3—(CO_2)_3]_2$ ($0 \le y \le 1$; M=Cu, Fe, Mn, Cr, V, Al, Ti, Zr or Mg; X=Cl, Br, I or F) or $M_3X_{1-y}(OH)_y(H_2O)_2O[C_6H_4(CO_2)_2]_3$ ($0 \le y \le 1$; M=Cu, Fe, Mn, Cr, V, Al, Ti, Zr or Mg; X=Cl, Br, I or F), or a hydrate thereof. In one embodiment, said hydrate can be represented as formula $M_3O(H_2O)_2X_{1-y}(OH)_y[C_6H_3—(CO_2)_3]_2.nH_2O$ ($0 \le y \le 1$; M=Cu, Fe, Mn, Cr, V, Al, Ti, Zr or Mg; X=Cl, Br, I or F; $0.1 \le n \le 50$) or $M_3X_{1-y}(OH)_y(H_2O)_2O[C_6H_4(CO_2)_2]_3.nH_2O$ ($0 \le y \le 1$; M=Cu, Fe, Mn, Cr, V, Al, Ti, Zr or Mg; X=Cl, Br, I or F; $0.1 \le n \le 50$). In some embodiments, X may be partially substituted with —OH in the formula above. In one illustrative embodiment, porous organic-inorganic hybrid materials having halogen element can be prepared by using metal halides or a hydrate thereof as a metal precursor.

In one embodiment, porous organic-inorganic hybrid materials can be prepared by reacting a metal precursor with an organic compound which may act as an organic ligand. In some embodiments, porous organic-inorganic hybrid materials can be prepared by a method including heating a reaction mixture including a metal precursor, an organic compound which may act as an organic ligand, and a solvent.

In some embodiments, the method of preparing porous organic-inorganic hybrid materials may include:

preparing a reaction mixture including a metal precursor, an organic compound which may act as an organic ligand, and a solvent; and heating the reaction mixture.

In one embodiment, a metal precursor can be a metal itself such as Sc, Y, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, Mg, Ca, Sr, Ba, Al, Ga, In, Tl, Si, Ge, Sn, Pb, As, Sb, Bi, etc., or a compound having such metal elements. In some embodiments, a metal precursor can be transition metals or compounds having transition metals. In one illustrative embodiment, in case said transition metal is chromium, vanadium, iron, nickel, cobalt, copper, titanium and manganese, it may be easier to prepare a coordination compound. In another embodiment, a metal precursor may include typical elements such as magnesium, calcium, aluminum, and silicon with which a coordination compound can be made, or a metal of lanthanoid series such as cerium and lanthanum.

In one embodiment, a compound having metal elements used as a metal precursor can be metal salts such as metal halide, metal nitrate, metal sulfate, metal acetate, metal carbonyl or metal alkoxide, or a hydrate thereof. Halogen can be referred to F, Cl, Br, or I. In some embodiments, metal precursors can be copper chlorides (e.g., $CuCl_2$), iron chlorides (e.g., $FeCl_3$), manganese chlorides (e.g., $MnCl_2$), chromium chlorides (e.g., $CrCl_3$), vanadium chlorides (e.g. $VCl_3$), titanium chlorides (e.g., $TiCl_4$), or a hydrate thereof. In another embodiment, a metal precursor may include copper nitrate, iron nitrate, manganese nitrate, chromium nitrate, vanadium nitrate, zinc nitrate, or a hydrate thereof, but is not limited thereto.

In one embodiment, an organic compound which may act as an organic ligand includes an organic compound having functional groups that can coordinate. In some embodiments, examples of functional groups that can coordinate may include, but not limit to, carbonic acid group (—$CO_3$), anion group of carbonic acid (—$CO_2^-$), carboxyl, anion group of carboxylic acid, amino group (—$NH_2$), imino group

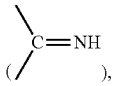

amide group (—$CONH_2$), sulfonic acid group (—$SO_3H$), anion group of sulfonic acid (—$SO_3^-$), methanedithioic acid group (—$CS_2H$), anion group of methanedithioic acid (—$CS_2^-$), pyridine group, pyrazine group, etc.

In one embodiment, examples of an organic compound which can act as an organic ligand may include an organic compound such as bidentate or tridentate. In some embodiments, the compound having at least two sites for coordination can derive stable porous organic-inorganic hybrid materials. In one embodiment, the examples of the organic compound which may act as an organic ligand may be a neutral organic compound such as bipyridine, pyrazine, etc., anionic organic compounds, e.g., anions of carboxylic acid such as terephthalate, naphthalenedicarboxylate, benzenetricarboxylate, benzenetribenzoate, pyridinedicarboxylate, bipyridyldicarboxylate, etc., and cationic materials, if these have a site for coordination. In another embodiment, as for the anions of carboxylic acid, in addition to anions having aromatic rings such as terephthalate, any anions, e.g., linear carboxylic acid anions such as formate, oxalate, malonate, succinate, glutamate, hexanedioate and heptanedioate and anions having non-aromatic rings such as cyclohexyldicarboxylate can be used.

In another embodiment, as the organic compound which may act as an organic ligand, in addition to an organic compound having a site for coordination, an organic compound which has a potential site for coordination and thus can be converted into a form capable of forming a coordinate bond under reaction conditions can also be used. For example, in case of using an organic acid such as terephthalic acid, terephthalic acid converts into terephthalate after reaction and thus can bond to a metal component. In some embodiments, examples of the organic compounds include organic acids such as benzenedicarboxylic acid, naphthalenedicarboxylic acid, benzenetricarboxylic acid, naphthalenetricarboxylic acid, benzenetribenzoic acid, pyridinedicarboxylic acid, bipyridyldicarboxylic acid, formic acid, oxalic acid, malonic acid, succinic acid, glutamic acid, hexanedioic acid, heptanedioic acid and cyclohexyldicarboxylic acid; and an anion thereof; pyrazine, bipyridine, dihydroxyterephthalic acid, etc. In some embodiments, at least one organic compound can be used in combination.

In one embodiment, a solvent which can dissolve both metal precursors and organic compound which may act as an organic ligand can be used. In some embodiments, examples of the solvent include water, alcohol, ketones, hydrocarbons, N,N-dimethylformamid (DMF), N,N-diethylformamid (DEF), N,N-dimethylacetylamid (DMAc), acetonitrile, dioxane, chlorobenzene, pyridine, N-methylpyrrolidone (NMP), sulfolane, tetrahydrofuran (THF), gamma butyrolactone, alicyclic alcohol such as cyclohexanol, etc., but are not limited thereto. In another embodiment, at least two solvents can be mixed together. In another embodiment, as the solvent, one or a mixture of at least two selected from water; mono or poly alcohols having 1~10 carbon atoms such as methanol, ethanol, propanol, alkylene polyol such as ethylene glycol, glycerol, polyalkylene polyol such as polyethylene glycol; ketones having 2~10 carbon atoms such as acetone, methylethylketone, acethylacetone and hydrocarbons having 4~20 carbon atoms (e.g., a linear or cyclic alkanes having 4~10 carbon atoms such as hexane, heptane, octane and toluene) can be used. In one illustrative embodiment, water, EG, DMF or THF can be used as said solvent.

The molar ratio of the metal precursor and the organic compound which may act as the organic ligand can be properly adjusted depending on the kind of the metal component and organic compound. In one embodiment, the molar ratio of the metal precursor and the organic compound which may act as the organic ligand is 1:0.1~500, but is not limited to it. In another embodiment, the molar ratio of the metal precursor and the organic compound which may act as the organic ligand can be 1:0.1~100 or 1:0.1~10.

The heating temperature of the reaction mixture is not substantially limited. In some embodiments, the temperature can be at least room temperature. In another embodiment, the temperature can be at least 20° C., or at least 50° C., at least 60° C., at least 80° C. or at least 100° C. In some embodiment, the heating temperature can be 250° C. or lower.

While heating the reaction mixture, the reactor pressure is not substantially limited. In one embodiment, the reaction may be performed at autogeneous pressure of the reaction materials at reaction temperature within the reactor. In another embodiment, the reaction may be performed at high pressure by adding inert gas such as nitrogen or helium.

In another embodiment, porous organic-inorganic hybrid materials with crystallinity can be prepared by a method including preparing the reaction solution including a mixture of at least one inorganic metal precursor, at least one organic compound which may act as at least one ligand and a solvent; and forming porous organic-inorganic hybrid materials with crystallinity by reacting the reaction solution, where the reaction is conducted under the pressure of about 3 atm or less. Porous organic-inorganic hybrid materials with crystallinity can be synthesized by any conventional method such as the hydrothermal synthesis, solvothermal synthesis, irradiating microwave sono synthesis, etc. In one embodiment, porous organic-inorganic hybrid materials can be prepared by a solvent dissolving at near room temperature or a hydrothermal synthesis at high temperature using water solvent. In another embodiment, porous organic-inorganic hybrid materials with crystallinity can be prepared by a solvothermal synthesis using an organic solvent [Microporous Mesoporous Mater., vol. 73, p. 15 (2004)]. In another embodiment, porous organic-inorganic hybrid materials with crystallinity are in general prepared by a method of using water or an appropriate organic solvent, conducting a reaction at a temperature higher than the boiling point of the solvent or reaction solution and autogenous pressure, and performing a crystallization, similarly to the method for preparing inorganic porous materials such as zeolite and mesoporous compounds. In some embodiments, a metal ion or metal compound and an organic ligand are stirred or microwaves are irradiated on them for a certain time in the presence of a solvent, so that the organic compound coordinates with the metal to form a crystallization nucleus. Then, crystallization is performed by irradiating microwaves to the reaction solution in which crystallization nuclei are formed.

In some embodiments, in order to remarkably increase the crystallizing rate under the synthesis condition of high concentration and control the crystal growth rate and the automatic adsorption rate of solvent during reaction, it is preferable to carry out synthesis at a low pressure of 3 atm or less. In some embodiments, the reaction may be carried out at 2.5 atm or less, or at 2 atm or less. Without being bound by theory, it is believed that even in case of using a solvent having a boiling point lower than the reaction temperature, the pressure does not increase since the crystal of porous organic-inorganic hybrid materials adsorbs the solvent rapidly. In case of carrying out a reaction under the low pressure condition according to one embodiment, especially in a low pH condition, it is possible to use various types of low-priced reactors instead of an expensive high pressure reactor, which could reduce the investment costs for the preparation of porous organic-inorganic hybrid materials with crystallinity. In addition, when porous organic-inorganic hybrid materials with crystallinity are prepared according to a method performed at a low pressure of 3 atm or less, in spite of such a low pressure condition, porous organic-inorganic hybrid materials have high crystallinity and uniform distribution of particle size can be provided regardless of the presence or absence of a crystallization agent (e.g., hydrofluoric acid).

In one embodiment, the reaction is carried out under the condition where a metal precursor is present in a reaction solution in a high concentration. For example, the molar ratio of the solvent to the inorganic metal precursor in the reaction solution is 100 or less. In another embodiment, the molar ratio of the solvent to the inorganic metal precursor in the reaction solution is 60 or less, 50 or less, or 25 or less. When the reaction is carried out under high pressure conditions, the crystallizing rate for porous organic-inorganic hybrid materials and/or the yield of the porous organic-inorganic hybrid materials with crystallinity obtained per unit reactor volume can be increased.

The method for preparing porous organic-inorganic hybrid materials with crystallinity according to another embodiment may further include purifying an impurity in the porous organic-inorganic hybrid materials obtained in the step 2 by treatment with an inorganic salt, an acid adjuster, a solvent, or a mixture thereof. This step may be additionally carried out for increasing the surface area of porous organic-inorganic hybrid materials by removing the chelated organic or inorganic impurities from the pores by using a solvent, inorganic salt, acid adjuster or a mixture thereof, in order to remove metal salts and their counter ions or organic ligands present in the pores of porous organic-inorganic hybrid materials with crystallinity.

Examples of the inorganic salt according to one embodiment include a monovalent or divalent cation selected from the group consisting of ammonium ($NH_4^+$), alkali metals and alkaline earth metals, and a monovalent or divalent anion selected from the group consisting of carbonate anion ($CO_3^{2-}$), nitrate ion and sulfate ion. In some embodiments, examples of the inorganic salt include salts having $Ca^{2+}$ or $Mg^{2+}$ as a divalent cation. In another embodiment, examples of the inorganic salt include salts having $F^-$, $I^-$ or $Br^-$ as a monovalent anion. In another embodiment, examples of the inorganic salt include salts having a monovalent cation and divalent anion. In one illustrative embodiment, examples of the inorganic salt include $NH_4F$, KF, KI, or KBr.

The use of an acid adjuster can reduce the time for the purification of porous organic-inorganic hybrid materials with crystallinity, and thus can make the process economical. In one embodiment, a basic compound can be used as a pH adjuster. In one specific embodiment, ammonia or potassium hydroxide can be used.

In one embodiment, the porous organic-inorganic hybrid materials have an unsaturated metal site, and a surface-functionalizing compound binds to the unsaturated metal site. In one embodiment, the surface of the porous organic-inorganic hybrid materials may be modified or functionalized by the binding of a surface-functionalizing compound having various functional groups to the unsaturated metal site of the porous organic-inorganic hybrid material. The term unsaturated metal site refers to an accessible coordination site at the metal after removal of water or solvent from the porous organic-inorganic hybrid material. It also refers to a site where a compound having a functional group can form a covalent bond or coordinate bond. Such surface-functionalization can be carried out according to the disclosure of Korean Patent Publication No. 10-0864313, 10-0816538, etc., incorporated herein by reference.

In one embodiment, a surface-functionalizing compound which can be bonded to unsaturated metal sites may be at least one selected from organic substances, inorganic substances, ionic liquids, or organic-inorganic hybrid substances.

In one embodiment, the organic substance may be at least one selected from among the compounds represented by Formulas 1 to 3 below:

$H_2N$-M-R1 [Formula 1]

HS-M-R2 [Formula 2]

$(OH)_2OP$-M-R3 [Formula 3]

where M is an alkylene or aralkylene group of $C_1$~$C_{20}$ including or not including unsaturated hydrocarbons, and each of R1, R2 and R3 is independently an organic alkylene or aralkylene group, unsubstituted or substituted with at least one selected from among halogen elements, a vinyl group (—C═$CH_2$), an amino group (—$NH_2$), an imino group (—$NHR^{14}$), a mercapto group (—SH), a hydroxyl group (—OH), a carboxylic acid group (—COOH), a sulfonic acid group (—$SO_3H$), an alkoxy group (—OR) and a phosphoric group (—$PO(OH)_2$).

In one embodiment, as the inorganic substance, polyoxometallate of $[AlO_4Al1_2(OH)_{24}(H_2O)_{12}]^{7+}$ or $[PW_{12}O_{40}]^{4-}$ may be used. The polyoxometallate may include a structure of Keggin anion $[(XM_{12}O_{40})^{n-}$, where n is an integer of 1~10; X is P, Si, H, Ga, Ge, V, Cr, Me or Fe; and M is at least one selected from among W, Mo, and Co], a structure of Lindqvist anion $[(M_6O_{19})^{n-}$, where n is an integer of 1~10; and M is W, Mo, Ta, V or W], a structure of Anderson-Evans anion $[(M_x(OH)_6M_6O_{18})^{n-}$, where n is an integer of 1~10; $M_x$ is Cr, Ni, Fe, or Mn; and M is Mo, or W] or $[(M_4(H_2O)_4(P_2W_{15}O_{56})_2)^{n-}$, where n is an integer of 1~10; and M is at least one transition metals or transition metal clusters selected from Cu, Zn, Ni, Mn, and the like], or Dawson-Wells structure $(P_2W_{15}O_{56})_2$.

In one embodiment, the ionic liquids may be at least one salt selected from ammonium, phosphonium, sulphonium, pyrrolidinium, imidazolium, thiazolium, pyridium or triazolium.

In one embodiment, the organic-inorganic hybrid substances may be organic metal compounds. In some embodiments, among the organic metal compounds, compounds including organic silicone may be used as organic silane compounds. Specific examples of the organic silane compounds may include silylating agents, silane coupling agents, silane polymers, and mixtures thereof. Among the surface functionalizing compound, organic silane compounds can be easily bonded to the coordinatively unsaturated metal sites of the porous organic-inorganic hybrid materials and are stable after bonding. In some embodiments, among the organic silane compounds, an organic silane compound, having an alkoxy group at one side thereof and having an alkyl group, an alkenyl group and an alkynyl group having a functional group selected from an amino group and a mercapto group at the other side, can form stable bonds with the porous organic-inorganic hybrid materials and has high catalytic activity.

In one embodiment, the organic metal compounds as the organic-inorganic hybrid substance can be at least one selected from compounds represented by Formulas 4 to 11 below:

$$Si(OR^1)_{4-x}R_x(1\leq x\leq 3) \quad \text{[Formula 4]}$$

$$Si(OR^3)_{4-(y+z)}R^2_yZ_z(1\leq y+z\leq 3) \quad \text{[Formula 5]}$$

$$Si(OR^4)_{4-a}R^5_aSi(1\leq a\leq 3) \quad \text{[Formula 6]}$$

$$Z^1_b(OR^6)_{3-b}Si\text{-}A\text{-}Si(OR^7)_{3-C}Z^2_C(0\leq b\leq 2,\ 0\leq c\leq 2) \quad \text{[Formula 7]}$$

$$R^8_eM^1(OR^9)_{4-e}(1\leq e\leq 3) \quad \text{[Formula 8]}$$

$$R^{10}_gM^2Z^3_f(OR^{11})_{4-(f+g)}(1\leq f+g\leq 3) \quad \text{[Formula 9]}$$

$$M^3(OR^{12})_h(1\leq h\leq 2) \quad \text{[Formula 10]}$$

$$M^4(OR^{13})_iZ^4_j(1\leq i+j\leq 2) \quad \text{[Formula 11]}$$

where A is an alkylene or aralkylene group of $C_1$~$C_{20}$ including or not including unsaturated hydrocarbons, each of $Z^1$, $Z^2$, $Z^3$ and $Z^4$ is independently selected from halogen elements, each of $M^1$ and $M^2$ is independently at least one element selected from transition metals, Lanthanides and Actinides, each of $M^3$ and $M^4$ is independently at least one element selected from alkali metals and alkaline earth metals, each R and $R^1$ to $R^{13}$ is independently an alkyl group, alkenyl group or alkynyl group of $C_1$~$C_{20}$, unsubstituted or substituted with at least one selected from halogen elements, a vinyl group (—C═$CH_2$), an amino group (—$NH_2$), an imino group (—$NHR^{14}$), a mercapto group (—SH), a hydroxyl group (—OH), and a carboxylic acid group (—COOH), or is selected from a vinyl group (—C═CH), an amino group (—$NH_2$), an imino group (—$NHR^{14}$), a mercapto group (—SH), a hydroxyl group (—OH) and a carboxylic acid group (COOH), and $R^{14}$ is an alkyl group, an alkenyl group or an alkynyl group of $C_1$~$C_{10}$, unsubstituted or substituted with halogen, an amino group, a mercapto group or a hydroxyl group.

In one embodiment, when functionalizing the porous organic-inorganic hybrid materials or mesoporous organic-inorganic material with two or more selected from organic substances, inorganic substances, ionic liquids or organic-inorganic hybrid substances, the mixtures of two or more substances may be used, or the method sequentially using other substances after the use of one of the substance may be used. In one embodiment, the porous organic-inorganic hybrid materials or mesoporous organic-inorganic material is first reacted with organic substances or organic metal compounds, and in the second step subsequently reacted with ionic liquids or inorganic polyoxometallates, thereby preparing a surface-functionalized porous organic-inorganic hybrid materials or mesoporous organic-inorganic material. This method is advantageous in that the dissolution of metals, which are active materials, can be prevented when functional groups are secondarily supported with the metals.

In one embodiment, the porous organic-inorganic hybrid materials may be provided in a form of powder, thin film, membrane, pellet, ball, foam, slurry, paste, paint, honeycomb, bead, mesh, fiber, corrugated sheet, etc. For example, the porous organic-inorganic hybrid materials in a form of thin film or membrane can be prepared by the method of immersing a substrate to a reaction solution and heating the substrate.

In some embodiments, the amount of organic or inorganic binder in shaped bodies may be 50% by weight or less based on the total weight of the shaped bodies. In one illustrative embodiment, examples of inorganic binders may include, but are not limited to, silica, alumina, boehmite, zeolite, mesoporous material, carbon, graphite, layer-structured compound, metal alkoxide, metal halide, etc. Examples of organic binders may include, but are not limited to, alcohol, cellulose, polyvinylalcohol, polyacrylate, etc.

In one illustrative embodiment, after preparing a ceramic paper prepared by using the inorganic fiber, the ceramic paper is single-side corrugated in a form of the corrugated paper and then a cylindrical honeycomb is prepared by rolling the single-side corrugated paper to become a cylindrical shape. The ceramic paper, single-side corrugated paper or cylindrical honeycomb as a substrate, is immersed in a reaction solution, and heated to prepare a dehumidifying part including porous organic-inorganic hybrid materials.

In one embodiment, the porous organic-inorganic hybrid materials described above has a great difference in its adsorptions at low and high temperatures, and accordingly is useful as an adsorbent. In another embodiment, the porous organic-inorganic hybrid materials have the characteristics of being easily desorbed at low temperatures (for example, 100° C. or below), and having a large adsorption amount of water per unit weight of the porous organic-inorganic hybrid materials and/or having a high absorption rate.

In one embodiment, porous organic-inorganic hybrid materials may desorb 10% or more of the adsorbed water within 5 minutes at the water desorption temperature of 100° C. or below. In another embodiment, the porous organic-inorganic hybrid materials may desorb 20% or more, 40% or more, 60% or more, or 75% or more of the adsorbed water within 5 minutes at the water desorption temperature of 100° C. or below.

In one embodiment, porous organic-inorganic hybrid materials can adsorb 0.1 g to 3 g of an adsorbate per 1 g of porous organic-inorganic hybrid materials. In some embodiments, the porous organic-inorganic hybrid materials can adsorb 0.1 g to 2 g of an adsorbate per 1 g of porous organic-inorganic hybrid materials at 100° C. or below, or 0.1 g or more, 0.2 g or more, 0.4 g or more or 0.5 g or more of an adsorbate per 1 g of porous organic-inorganic hybrid materials at 10° C. to 100° C. In another embodiment, the porous organic-inorganic hybrid materials can adsorb 1 g or less, 0.9 g or less, 0.8 g or less 0.7 g or less of an adsorbate per 1 g of porous organic-inorganic hybrid materials at 10° C. to 100° C.

In another embodiment, the porous organic-inorganic hybrid materials has a large surface area and pores of a molecule size or nano size, and thus can be used as an adsorbent, air storage material, sensor, membrane, functional thin film, catalyst, catalyst carrier, etc. In addition, the porous organic-inorganic hybrid materials can encapsulate guest molecules smaller than their pore size or can separate the molecules according to the sizes of the molecules by using their pores. In one illustrative embodiment, the adsorbent including the porous organic-inorganic hybrid materials can adsorb not only water, but also hydrogen, oxygen, nitrogen, hydrocarbon such as methane, paraffin or olefin, carbon monoxide, carbon dioxide, compound causing foul odor such as ammonia, compound having nitrogen such as trimethylamine, compound having sulfur such as methylsulfide or methylmercaptan, volatile organic compound (VOC) such as formaldehyde, acetaldehyde, etc. Thus, when the porous organic-inorganic hybrid materials are used in an apparatus for treating air, a fresh air from which various foul odor components are removed can be provided. In another embodiment when the porous organic-inorganic hybrid materials are used in the apparatus for treating air, gases such as hydrocarbon, NOx, CO, VOC, etc. included in the air received from outside can be effectively adsorbed•removed, and especially, the air from which NOx, etc. are removed can be provided to any desired place.

In one embodiment, the dehumidifying part (2) may further include a catalyst component that can decompose various VOCs, but it is not limited to a specific catalyst. When using the catalyst component capable of decomposing VOCs together, the efficiency in removing gases can be increased by decomposing pollutant included in the air introduced from outside.

For example, said catalyst can be a metal catalyst including platinum, silver, gold, palladium, ruthenium, rhodium, osmium, iridium, manganese, copper, cobalt, chromium, nickel, iron, zinc, or a combination of one or more thereof. Said metal catalyst can be provided in various forms combined with a carrier such as aluminum, silica, zeolite, zirconia, ceria-zirconia, porous organic-inorganic hybrid materials mentioned above.

In one embodiment, a metal catalyst bonded with a carrier can be obtained by preparing catalyst powder by supporting metal salt including palladium ion and ion of transition metal such as copper, manganese, nickel, chromium, cobalt, etc. in a porous carrier, oxide carrier, etc. In some embodiments, a catalyst slurry can be prepared by combining said catalyst powder and an adsorbent such as porous organic-inorganic hybrid materials with binder such as bentonite, silica colloid, methyl cellulose, etc., and a honeycomb type monolith catalyst can be prepared by wet-coating said catalyst slurry on a honeycomb carrier surface. This metal catalyst can be prepared as disclosed in Korean Patent Laid-Open No. 10-2001-0037883 incorporated herein by reference.

In another illustrative embodiment, a metal catalyst may be a metal-supported organic-inorganic mesoporous material catalyst including a lipophilic group in its skeleton of mesoporous material, and an active metal that is well dispersed in pores of a porous material. The organic-inorganic mesoporous materials supporting a metal component can be prepared by, but are not limited to, a method including: preparing a mixture by stirring the noble metal compounds including an ion of metal such as platinum, silver, gold, palladium, ruthenium, rhodium, osmium, iridium, etc. with chelating agent and organic silane compound; preparing an organic-inorganic silica mesoporous material in which the metal component is dispersed by hydrothermal reaction of said mixture; and calcining said organic-inorganic silica mesoporous material. Such metal catalyst can be prepared as disclosed in Korean Patent Registration Publication No. 10-0816485 incorporated herein by reference.

In yet another illustrative embodiment, a metal catalyst may be a catalyst in which at least one metal component are supported on alumina, hydrophobic zeolite, etc. Examples of metal components may include noble metals such as platinum, palladium, etc. or transition metals such as copper, cobalt, chromium, zinc, iron, silver, nickel, etc. Examples of hydrophobic zeolite may include, but are not limited to, MFI (HZSM-5), FAU (HY), Mordenite (HMOR), Beta (H-Beta), etc. A metal catalyst may be a provided in a form of pellet, honeycomb, etc. Korean Patent Registration Publication No. 10-0578106 incorporated herein by reference may be referred to such metal catalyst.

In one embodiment, in case of using an adsorbent including the porous organic-inorganic hybrid materials in an apparatus for treating air, since a dehumidifying part is in a state of low humidity, microorganism can be reduced when passing through the dehumidifying part, the propagation of mold or bacteria can be inhibited, and airborne bacteria or mold can be reduced in indoor atmosphere. In some embodiments, in case the metal component having an antibacterial activity against various bacteria is substituted in the porous organic-inorganic hybrid materials, bacteria, etc. included in the air received from outside is removed due to an antibacterial function so that fresh air can be provided to a desired place.

An apparatus for treating air including the porous organic-inorganic hybrid materials can be used not only in ordinary houses, but also in various industries such as a chemical industry, food industry, electric•electronic industry, precision machinery industry, textile industry, printing industry, military industry, etc. that require a dehumidification and/or conditioning, cooling or treating air.

Examples described below are to further explain features and advantages of the subject matter of the present disclosure, but not limited to the examples presented below. The subject matter of the present disclosure should not be limited to the specific embodiments and examples described herein. In light of the present disclosure, a skilled artisan may easily perceive that it is possible to modify, substitute, add and combine a part of the constitutions disclosed in the present disclosure other than various illustrative embodiments and examples.

EXAMPLES

Example 1

After adding $Cr(NO_3)_3.9H_2O$, and 1,4-benzenedicarboxylic acid (BDCA) to a Teflon reactor, distilled water was added so that the final molar ratio of the reaction material was Cr:BDCA:$H_2O$=1:1:272. After putting the Teflon reactor including said reaction material in a convection oven and reacting it for 11 hours at 210° C., it was cooled to room temperature, centrifuged, washed with distilled water and dried to obtain chromium terephthalate (Cr-BDC) with a surface area of 3,300 $m^2/g$ as porous organic-inorganic hybrid materials. After vacuum drying the obtained organic-inorganic hybrid materials Cr-BDC 0.1 g at 70° C. for 30 minutes, a water adsorption test was performed by a gravimetric method. At a relative humidity of 60%, the water adsorption amount per weight of the adsorbent was 1.2 g/g (within 3 hours).

Example 2

After adding iron salt (iron nitrate) 1 mmol, and 1,3,5-benzenetricarboxylic acid (BTCA) 0.67 mmol to a Teflon reactor, acid and distilled water were added. The final molar ratio of the reaction material was $Fe:HNO_3:BTCA:H_2O=1:0.7:0.67:278$. After putting the Teflon reactor including said reaction material in a convection oven, crystallization was performed while maintaining the reaction material at 160° C. for 8 hours. Then, the reaction mixture was cooled to room temperature, centrifuged, washed (with distilled water) and dried to obtain porous organic-inorganic hybrid materials (Fe-BTC) with a surface area of 2,200 $m^2/g$. After vacuum drying the obtained organic-inorganic hybrid materials Cr-BDC 0.1 g at 70° C. for 30 minutes, a water adsorption test was performed by a gravimetric method. At a relative humidity of 60%, the water adsorption amount per weight of the adsorbent was 0.8 g/g. As such, it can be shown that the porous organic-inorganic hybrid materials easily adsorb and desorb water even at a low temperature of 100° C. or below, it can achieve a very excellent efficiency in humidifiers, dehumidifiers, etc.

Example 3

After adding iron salt 1 mmol, and 1,3,5-benzenetricarboxylic acid (BTCA) 0.67 mmol to a Teflon reactor, distilled water was added. The final molar ratio of the reaction material was $Fe(NO_3)_3.9H_2O:BTCA:H_2O=1:0.67:278$. After putting the Teflon reactor including said reaction material in a convection oven, crystallization was performed while maintaining the reaction material at 160° C. for 8 hours. Then, the reaction material was cooled to room temperature, centrifuged, washed (with distilled water) and dried to obtain porous organic-inorganic hybrid materials (Fe-BTC) with a surface area of 1,800 $m^2/g$. After vacuum drying the obtained organic-inorganic hybrid materials Fe-BTC 0.1 g at 70° C. for 30 minutes, a water adsorption test was performed by a gravimetric method. At a relative humidity of 60%, the water adsorption amount per weight of the adsorbent was 0.6 g/g. As such, it can be shown that the porous organic-inorganic hybrid materials easily adsorb and desorb water even at a low temperature of 100° C. or below, it can achieve a very excellent efficiency in humidifiers, dehumidifiers, etc.

Example 4

Porous organic-inorganic hybrid materials were prepared by using aluminum nitrate hydrate, instead of iron nitrate of Example 3. The surface area of Al-BTC prepared having the same structure was 1,720 $m^2$.

Example 5

After adding $TiCl_4$ 0.227 mmol, and 1,4-benzenedicarboxylic acid ($H_2BDC$) 0.227 mmol to a Teflon reactor, N,N-dimethylformamide (DMF) 340 mmol was added. The reaction material was stirred in 50 rpm for 20 minutes at room temperature to make a reaction mixture. After mounting the Teflon reactor including said reaction material on a microwaves reactor (Milestone company) and then raising the temperature to 120° C. by irradiating microwaves, crystallization was performed while maintaining the reaction material at 120° C. for 1 hour. Then, the reaction material was cooled to room temperature, centrifuged, washed (with distilled water) and dried to obtain porous organic-inorganic hybrid materials (Ti-BDC).

Example 6

After adding $CrCl_3.9H_2O$, and 1,4-benzenedicarboxylic acid (BDCA) to a Teflon reactor, distilled water was added and then the reaction materials were mixed so that the final molar ratio of the reaction material was $Cr:BDCA:H_2O=1:1:272$. After putting the Teflon reactor including said reaction materials in an electric oven and reacting it for 16 hours at 210° C., it was cooled to room temperature, centrifuged, washed with distilled water and dried to obtain chromium terephthalate (Cr-BDC) as porous organic-inorganic hybrid materials.

It has been confirmed that the XRD pattern of the chromium terephthalate crystal obtained from the present example was consistent with the values published in a reference [Science 23, 2040, 2005]. In addition, as a result of nitrogen adsorption and desorption experiments, it has been confirmed that the adsorption amount was 1,200 ml/g and the surface area was 3,800 $m^2/g$ at a relative pressure of 0.5, thus obtaining a high surface area. In addition, as a result of ICP analysis, it has been confirmed that the structure of the obtained porous organic-inorganic hybrid materials chromium terephthalate is the same as that of MIL-100, but it does not include F in its structure, thus being materials that can be represented by formula of $Cr_3(Cl_{0.8}(OH)_{0.2})(H_2O)_2O[C_6H_4(CO_2)_2]_3$.

Example 7

After adding metal (iron) chloride ($FeCl_3$) 40.8 mmol, and 1,3,5-benzenetricarboxylic acid (BTCA) 26.8 mmol to a Teflon reactor, distilled water was added. The final molar ratio of the reaction material was $FeCl_3:BTCA:H_2O=1:0.66:54$. The reaction material was stirred in 500 rpm for 20 minutes at room temperature to make the reaction material uniform. After crystallization was performed while maintaining the Teflon reactor including said pre-treated reaction material at the reaction temperature of 160° C. for 8 hours, the reaction material was cooled to room temperature, washed (with distilled water) and dried to obtain porous organic-inorganic hybrid materials (Fe-BTC).

It is shown that the shape of the X-ray diffraction pattern was the same as that of the MIL-100 (Fe) structure which is the crystal structure published in a reference [Chemical Communication 2820, 2007]. As a result of ICP analysis, it can be known that the structure of the iron terephthalate, which is porous organic-inorganic hybrid materials obtained, is the same as that of the MIL-100, but does not include F within its structure, and it is a material that can be represented by formula of $Fe_3O(H_2O)_2Cl[C_6H_3—(CO_2)_3]_2$. As a result of the nitrogen adsorption and desorption test, it has been confirmed that the surface area was 1,500 $m^2/g$ and the adsorption amount was 450 ml/g at $P/P_0=0.5$. As a result of the analysis of electron microscope, it can be shown that the particle size was ~500 nm.

Example 8

After putting the porous organic-inorganic hybrid materials 1 g prepared in Example 7 into 1M $NH_4F$ 50 ml and stirring it at 70° C., an organic-inorganic hybrid materials with improved specific surface area was prepared by removing impurities that exist in pores of the porous materials.

From the X-ray diffraction pattern, it can be confirmed that its crystallinity was maintained without being damaged after treating with ammonium fluoride. Also, the surface area of the porous organic-inorganic hybrid materials after treating with ammonium fluoride was measured to be 1,820 $m^2/g$, and the adsorption amount was measured to be 550 ml/g at $P/P_0=0.5$ Example 9

Porous organic-inorganic hybrid materials were prepared in the same manner as in Example 7 except that the organic-inorganic hybrid materials was prepared by heating by using microwaves instead of electric heating as a heat source. As to the microwave heating, after mounting the Teflon reactor including the mixed solution prepared in Example 7 on a microwaves reactor (CEM company, model Mars-5) and then raising the temperature to 180° C. by irradiating microwaves (2.54 GHz), crystallization was performed while maintaining the reaction material at 180° C. for 30 minutes. Then, the reaction materials were cooled to room temperature, centrifuged, washed (with distilled water) and dried to obtain porous organic-inorganic hybrid materials (Fe-BTC).

As a result of XRD analysis, it can be confirmed that relative intensity of the peak was different; however, a diffusion pattern was shown in the same position as Example 7 as for the porous organic-inorganic hybrid materials prepared in the present example. From the result of measuring the surface area, it showed that a surface area is 200 $m^2/g$ higher than an electric heating method. As a result of analysis of electron microscope, a relatively uniform crystal whose particle size of the organic-inorganic hybrid materials is 1 μm was obtained.

Example 10

Porous organic-inorganic hybrid materials were prepared in the same manner as in Example 7 except that $VCl_3$ was used instead of $FeCl_3$ as in Example 7. The X-ray diffraction pattern shows that the material having the same structure as in Example 7 was obtained. The electron microscope photograph shows that the porous organic-inorganic hybrid materials having uniform particle size of 100 nm was obtained.

Example 11

Using $CuCl_2$ instead of $FeCl_3$ as in Example 7, after adding a mixture of $H_2O$ and ethanol as a solvent, a reaction mixture was prepared so that the final molar ratio was Cu:BTCA:EtOH:$H_2O$=1:0.56:14.4:14.4. At this time, the reaction mixture was irradiated with supersonic waves at room temperature, and a pre-treatment was performed for 5 minutes to make a reaction mixture uniform and easily form nuclei. After mounting the Teflon reactor including said pre-treated reaction mixture on a microwaves reactor (CEM company, model Mars-5), the temperature was raised to 140° C. for 2 minutes by irradiating microwaves of 2.54 GHz. Thereafter, after reacting it while maintaining the reaction mixture at 140° C. for 30 minutes, it was cooled to room temperature and filtered powder by using a paper filter. It is shown that the shape of the X-ray diffraction pattern was the same as that of the HKUST-1 structure which is the crystal structure published in a reference [Science 283 (1999) 1148].

Example 12

Porous organic-inorganic hybrid materials were prepared in the same manner as in Example 8 except that Fe was used instead of $FeCl_3$ as in Example 8. The X-ray diffraction pattern shows that the material having the same structure as in Example 8 was obtained, and the surface area of the obtained porous organic-inorganic hybrid materials was 1,300 $m^2/g$.

Example 13

After adding $Ni(CH_3COO)_2.4H_2O$, and 2,5-dihydroxyterephthalic acid (DHT) to a Teflon reactor, distilled water and THF were added so that the final molar ratio of the reaction material was Ni:DHT:$H_2O$:THF=1:0.5:367:140. The reaction material was stirred in 50 rpm for 20 minutes at room temperature, to make a reaction mixture. After mounting the Teflon reactor including said reaction material on a microwaves reactor (CEM company, model Mars-5) and raising the temperature to 110° C. by irradiating microwaves (2.54 GHz), crystallization was performed while maintaining the reaction mixture at 110° C. for 10 minutes. Then, the reaction mixture was cooled to room temperature, washed (with distilled water) and dried to obtain porous organic-inorganic hybrid materials (Ni-DHT). It has been confirmed that the XRD pattern of the crystal obtained from the present example was consistent with the values published in a reference [J. AM. CHEM. SOC. 130, 10870, 2008]. It has been confirmed that the particle size calculated from the Full Width Half Max (FWHM) of the XRD pattern was 28 nm. In addition, as a result of the analysis of electron microscope, it can be known that a secondary particle size of Ni-DHT was 200 nm.

Example 14

After adding $Mg(NO_3)_2.6H_2O$ 1.85 mmol, and 2,5-dihydroxyterephthalic acid (DHT) 0.559 mmol to a Teflon reactor, 50 ml of DMF-ethanol-water was added in a ratio of 15:1:1 (v/v/v). The reaction material was stirred in 50 rpm for 20 minutes at room temperature, to make a reaction mixture. After mounting the Teflon reactor including said reaction material on a microwaves reactor (CEM company, model Mars-5) and raising the temperature to 125° C. by irradiating microwaves (2.54 GHz), crystallization was performed while maintaining the reaction mixture at 125° C. for 1 hour. Then, the reaction mixture was cooled to room temperature, washed (with distilled water) and dried to obtain porous organic-inorganic hybrid materials (Mg-DHT). As a result of XRD analysis for the porous organic-inorganic hybrid materials obtained from the present example, it can be confirmed that relative intensity of the peak was different; however, a diffraction pattern was shown in the same position as Example 13.

Example 15

After adding $Co(NO_3)_3.6H_2O$ 8.67 mmol, and 2,5-dihydroxyterephthalic acid (DHT) 2.43 mmol to a Teflon reactor, 50 ml of DMF-ethanol-water was added in a ratio of 1:1:1 (v/v/v). The reaction material was stirred in 50 rpm for 20 minutes at room temperature, to make a reaction mixture. After mounting the Teflon reactor including said reaction material on a microwaves reactor (CEM company, model Mars-5) and raising the temperature to 100° C. by irradiating microwaves (2.54 GHz), crystallization was performed while maintaining the reaction mixture at 100° C. for 1 hour. Then, the reaction mixture was cooled to room temperature, washed (with distilled water) and dried to obtain porous organic-inorganic hybrid materials (Co-DHT). As a result of XRD analysis for the porous organic-inorganic hybrid materials obtained from the present example, it can be confirmed that relative intensity of the peak was different; however, a diffraction pattern was shown in the same position as Example 13.

Example 16

After adding $ZrCl_4$ and 1,4-benzenedicarboxylic acid ($H_2BDC$) to a Teflon reactor, N,N-dimethylformamide (DMF) was added so that the final molar ratio of the reaction material was Zr:$H_2BDC$:DMF=1:1:497. The reaction material was stirred in 50 rpm for 20 minutes at room temperature, to make a reaction mixture. After mounting the Teflon reactor including said reaction material on a microwaves reactor (Milestone company) and raising the temperature to 120° C. by irradiating microwaves (2.54 GHz), crystallization was performed while maintaining the reaction mixture at 120° C. for 2 hours. Then, the reaction mixture was cooled to room temperature, washed (with distilled water) and dried to obtain porous organic-inorganic hybrid materials (Zr-BDC). It has been confirmed that the XRD pattern of the crystal obtained from the present example was consistent with the values published in a reference [J. AM. CHEM. SOC. 130, 13850, 2008]. As a result of the analysis of electron microscope, it can be known that the particle size was 200 nm, and its crystallinity is relatively uniform.

Example 17

After adding $ZrCl_4$ 0.227 mmol, and 1,4-benzenedicarboxylic acid ($H_2BDC$) 0.227 mmol to a Teflon reactor, N,N-dimethylformamide (DMF) and 2-propanol were added in a mole ratio of 5:5. The reaction material was stirred in 50 rpm for 20 minutes at room temperature, to make a reaction mixture. After mounting the Teflon reactor including said reaction material on a microwaves reactor (Milestone company) and raising the temperature to 120° C. by irradiating microwaves (2.54 GHz), crystallization was performed while maintaining the reaction mixture at 120° C. for 1 hour. Then, the reaction mixture was cooled to room temperature, washed (with distilled water) and dried to obtain porous organic-inorganic hybrid materials (Zr-BDC). As a result of XRD analysis for the prepared porous organic-inorganic hybrid materials, it can be confirmed that relative intensity of the peak was different; however, a diffraction pattern was shown in the same position as Example 16.

Example 18

After drying Cr-BDC 1 g obtained from Example 1 at 200° C. for 12 hours in a vacuum oven, water coordinated on an unsaturated metal site was dehydrated. The dehydrated Cr-BDC 1 g was put in toluene solution 50 ml with which 3-aminopropyltriethoxysilane (APS) 5.7 ml is mixed. Said solution was reflux-reacted at 110° C. for 12 hours to make the porous organic-inorganic hybrid materials of which an ethoxy functional group was coordinated on the unsaturated metal site. It has been confirmed that APS was coordinated in Cr-BDC from that the adsorption peak was detected at 2,800~3,000 $cm^{-1}$ and 3,200~3,400 $cm^{-1}$, which corresponds to an amino group (—$NH_2$) and ethyl group (—$CH_2CH_2$—) of APS by Infrared Spectroscopy.

Example 19

After adding $ZrCl_4$ 0.227 mmol, and 1,4-benzenedicarboxylic acid ($H_2BDC$) 0.227 mmol to a Teflon reactor, N,N-dimethylformamide (DMF) and ethanol were added in a mole ratio of 5:5. The reaction material was stirred in 50 rpm for 20 minutes at room temperature, to make a reaction mixture. After mounting the Teflon reactor including said reaction material on a microwaves reactor (Milestone company) and raising the temperature to 120° C. by irradiating microwaves (2.54 GHz), crystallization was performed while maintaining the reaction mixture at 120° C. for 1 hour. Then, the reaction mixture was cooled to room temperature, washed (with distilled water) and dried to obtain porous organic-inorganic hybrid materials (Zr-BDC) having a surface area of 1,320 $m^2/g$.

Example 20

100 g of Fe-BTC powder obtained from said Example 3 is mixed with 600 g of water to make slurry solution. Then, the slurry solution was wet-coated on a pre-treated cordierite honeycomb (Corning Korea company, 200 cell, 15×15×5 cm) (honeycomb pre-treatment condition: it is treated with 1M-$HNO_3$ at 70° C. for 5 hours, washed with distilled water, and dried in the air at 600° C. for 5 hours). Then, the honeycomb on which the Fe-BDC adsorbent is coated is dried in an oven at 70° C. to support the Fe-BTC adsorbent in a honeycomb monolith support. The amount of Fe-BTC adsorbent supported therein is 30% by weight compared with the honeycomb support.

Example 21

After adding iron salt (iron nitrate) 1 mmol, and 1,3,5-benzenetricarboxylic acid (BTCA) 0.67 mmol to a Teflon reactor, distilled water was added. The final molar ratio of the reaction material was Fe:$HNO_3$:BTCA:$H_2O$=1:0.7:0.67:278. After putting the Teflon reactor including said reaction material in a convection oven, crystallization was performed while maintaining the reaction material at 160° C. for 8 hours. Then, the reaction material was cooled to room temperature, centrifuged and washed (with distilled water) to obtain porous organic-inorganic hybrid materials (Fe-BTC) in a form of slurry. The obtained Fe-BTC slurry was put in a cylinder type extruder, and the inside of the extruder was maintained in a vacuum state and extruded article was made at a slurry rotating speed of 50 rpm and a molding speed of 300 mm/min. The obtained extruded article was dried at 80° C. for 12 hours, and then was heated by a calcining furnace at 120° C. for 2 hours. BET surface area of the final extrusion-molded article was 1750 $m^2/g$.

Example 22

After adding iron nitrate ($Fe(NO_3)_3.6H_2O$) 67 mmol and 1,3,5-benzenetricarboxylic acid (BTCA) 44 mmol to a glass reactor, distilled water was added. The final molar ratio of the reaction material was $Fe(NO_3)_3.6H_2O$:BTCA:$H_2O$=1:0.66:11.3. The mixed reaction material was stirred in 500 rpm for 20 minutes at room temperature to make the reaction material uniform. While maintaining the glass reactor including said pre-treated reaction material at 120° C. for 8 hours, crystallization was performed. Then, the reaction material was cooled to room temperature, washed with distilled water and dried to obtain porous organic-inorganic hybrid materials (iron benzenetricarboxylate; Fe-BTC). As a result of measuring the reaction pressure when preparing the porous organic-inorganic hybrid materials (Fe-BTC), the internal pressure at 120° C. was 1 bar. Without being bound by theory, it appears that such low-pressure synthesis process results from that Fe-BTC crystal foamed rapidly adsorbs a solvent at the reaction temperature.

It has been confirmed with electron microscope that the prepared porous organic-inorganic hybrid materials were formed with very uniform particle size as nanoparticles of ~200 nm by adjusting nucleate growth rate. It has been confirmed that the X-ray diffraction pattern is same as that of Fe-BTC of a reference [Chemical Communication 2820, 2007], but as a result of ICP and EA analysis, it has been confirmed that the obtained porous organic-inorganic hybrid materials Fe-BTC were a material that can be represented by a formula $Fe_3O(H_2O)_2OH[C_6H_3—(CO_2)_3]_2.nH_2O$ ($0<n<50$) where fluorine was not included. As a result of a nitrogen adsorption-desorption experiment, it has been confirmed that it had a surface area of 1,850 $m^2/g$ and an adsorption amount of 540 mL/g at $P/P_0=0.5$. In particular, the yield of the porous organic-inorganic hybrid materials was 150 g per 1 L of reactor.

Porous organic-inorganic hybrid materials with improved surface area was prepared by removing impurities within the pores of hybrid materials after adding the prepared porous organic-inorganic hybrid materials 1 g to $NH_4F$ 50 mL and stirred at 70° C. The X-ray diffraction pattern showed that its crystallinity was maintained without being damaged after treating with ammonium fluoride. Further, the surface area of the porous organic-inorganic hybrid materials after treating with ammonium fluoride was measured to be 1,950 $m^2/g$.

Example 23

Porous organic-inorganic hybrid materials were prepared by the same method as Example 22, except that the mixture was prepared by further adding HF. The final molar ratio of the reaction material was $Fe(NO_3)_3.6H_2O$:BTCA:$H_2O$:HF=1:0.66:11.3:0.15. The mixed reaction material was stirred in 500 rpm for 20 minutes at room temperature to make the reaction material uniform. While maintaining the Teflon reactor including said pre-treated reaction material at 120° C. for 12 hours, crystallization was performed. Then, the reaction material was cooled to room temperature, washed with distilled water and dried to obtain porous organic-inorganic hybrid materials (Fe-BTC). As a result of measuring the reaction pressure when preparing the porous organic-inorganic hybrid materials (Fe-BTC), the internal pressure at 120° C. was 1 bar. Without being bound by theory, it appears that such result comes from that Fe-BTC crystal rapidly adsorbs a solvent at 120° C.

It has been confirmed that the X-ray diffraction pattern was the same structure as that of Fe-BTC of a reference [Chemical Communication 2820, 2007]. As a result of ICP and EA analysis, it has been confirmed that the obtained porous organic-inorganic hybrid materials Fe-BTC were a material that can be represented by a formula $Fe_3O(H_2O)_2F_{0.85}(OH)_{0.15}[C_6H_3—(CO_2)_3]_2.nH_2O$ ($0<y<1$, $0<n<50$). After vacuum drying 0.1 g of the obtained porous organic-inorganic hybrid materials Fe-BTC at 70° C. for 30 minutes, a water adsorption test was performed by the gravimetric method. At room temperature on a relative humidity of 60%, the water adsorption amount per weight of the adsorbent was measured to be 0.8 g/g. As such, it can be shown that the porous organic-inorganic hybrid materials can easily adsorb and desorb water even at a low temperature of 100° C. or below, it can achieve a very excellent efficiency in humidifiers, dehumidifiers, etc.

Example 24

Porous organic-inorganic hybrid materials (Fe-BTC) were prepared in the same method as Example 22 except that iron chloride ($FeCl_3.6H_2O$) was used as metal salt instead of iron nitrate. It has been confirmed that the X-ray diffraction pattern was the same structure as that of Fe-BTC of a reference [Chemical Communication 2820, 2007]. As a result of ICP and EA analysis, it has been confirmed that the obtained porous organic-inorganic hybrid materials Fe-BTC were a material that can be represented by a formula $Fe_3O(H_2O)_2Cl_{0.80}(OH)_{0.20}[C_6H_3—(CO_2)_3]_2.nH_2O$ ($0<y<1$, $0<n<50$) where fluorine was not included.

Example 25

Porous organic-inorganic hybrid materials (Fe-BTC) were prepared in the same method as Example 22 except that the reaction temperature is 100° C. It has been confirmed that the X-ray diffraction pattern was the same structure as that of Fe-BTC of a reference [Chemical Communication 2820, 2007], but as a result of ICP and EA analysis, it has been confirmed that the obtained porous organic-inorganic hybrid materials Fe-BTC were a material that can be represented by a formula $Fe_3O(H_2O)_2OH[C_6H_3—(CO_2)_3]_2.nH_2O$ ($0<n<50$) where fluorine was not included.

Example 26

Porous organic-inorganic hybrid materials were prepared in the same method as Example 22 except that aluminum nitrate hydrate was used instead of iron nitrate. As a result of measuring the nitrogen-adsorption amount after removing residual BTCA ligand by heating the obtained Al-BTC at 300° C. under nitrogen atmosphere, the surface area was 1,930 $m^2/g$.

Example 27

After adding water 10% by weight to Fe-BTC powder of Example 22 including 3% of BTC as a binder and introducing the kneaded Fe-BTC slurry to a cylinder-type extruder with the internal of the extruder maintained vacuum, an extruded article was prepared at a cylinder rotating rate 50 rpm and at a molding rate 300 mm/min. The prepared extruded article was dried at 80° C. for 12 hours, and then heated at 120° C. for 2 hours by using a oven. The BET surface area of the final extrusion-molded article was 1,750 $m^2/g$.

Example 28

(1) Preparation of Catalyst Powder and Slurry for Wet-Coating $PdCl_2$ (6.10 g), $CuCl_2.2H_2O$ (18.80 g) and $Cu(NO_3)_2.3H_2O$ (62.80 g) was put in 1 L of distilled water in order, and when it became transparent solution, USY-zeolite (200 g; PQ company, $SiO_2/Al_2O_3=80$, $S_{BET}=780$ $m^2/g$) was put therein. Under a water bath at 70° C., the solution was stirred until the remaining water was all evaporated. Then, (Pd, Cu)/USY catalyst powder with the Pd content of 1.6% by weight and Cu content of 10.35% by weight was prepared by drying the obtained product at 110° C. for 3 hours and calcining it at 400° C. for 6 hours.

After mixing obtained (Pd, Cu)/USY catalyst powder, bentonite (Junsei company) and distilled water in a weight ratio of 12/3/35, they are sufficiently dispersed while being stirred for 30 minutes to make the catalyst slurry for wet-coating whose solid content is 30% by weight.

(2) Preparation of Honeycomb Type Monolithic Catalyst

After putting the honeycomb type cordierite (Corning Korea company, 200 cell, 15×15×5 cm) obtained in Example 20 in said catalyst slurry for wet-coating for 5 minutes, it was taken out and then compressed air was blown not to clog a honeycomb hole. Then, it was dried at 100° C. for 3 hours. After repeating said coating-drying process twice, it is dried at 100° C. for 12 hours in the end. The dried honeycomb monolith catalyst was calcined at 500° C. for 6 hours to complete a wet-coating. During said wet-coating, the coating amount of catalyst powder per honeycomb carrier volume was 42.7 g/L, the Pd content of the obtained monolith catalyst was 0.67 g/L per catalyst volume, and the Cu content was 4.42 g/L per catalyst volume.

After reduction of the obtained honeycomb type monolith catalyst at 300° C. for 3 hours by 5% hydrogen before use, the catalyst was mounted on an apparatus for measuring catalyst combustion activity for methylethylketone (MEK), which is a VOC material. The size of catalyst used was Φ4 cm×5 cm, the temperature of column attached to GC (Gas chromatography) was 50° C., and the temperature of FID (Flame Ionization Detector) was 200° C. The experiment was conducted under a dry state, the inlet concentration of VOC was 500 ppm, and a gas hourly space velocity (GHSV) was adjusted to 30,000 $h^{-1}$. In case of the (Pd, Cu)/USY catalyst, it has been confirmed that 99% of MEK was removed at 210° C. and 95% at 220° C.

Example 29

$PdCl_2$ (0.38 g), $CuCl_2.2H_2O$ (18.80 g) and $Cu(NO_3)_2.3H_2O$ (62.80 g) was put in 1 L of distilled water in order, and when it became transparent solution, γ-$Al_2O_3$ (200 g; Strem company, $S_{BET}$=150 $m^2/g$) was put therein. Then, (Pd, Cu)/$Al_2O_3$ catalyst powder with the Pd content of 0.10% by weight and Cu content of 10.35% by weight, and catalyst slurry for wet-coating with the solid content of 30% by weight were prepared in the same manner as in said Example 27. In addition, a honeycomb type monolithic catalyst with the Pd content of 0.04 g/L and Cu content of 4.42 g/L based on the volume of the catalyst was prepared by performing a wet-coating process as in Example 27.

Comparative Example 1

Zeolite Y (Aldrich company, Si/Al=5.6, specific surface area=827 $m^2/g$, pore volume=0.35 ml/g) used as a commercial water adsorbent was prepared. As a result of performing the water adsorption experiment in the same manner as in Example 2 after vacuum drying zeolite Y adsorbent at 200° C. for 30 minutes, the water adsorption amount was 0.35 g/g. That is, although the desorption temperature of the adsorbent of Example 2 was 70° C., the adsorbent of the present disclosure showed a water adsorption amount that is at least 2.2 times larger.

Comparative Example 2

Carbon (Ecopro Carbon specific surface area=665 $m^2/g$, pore volume=0.39 ml/g) used as a commercial water adsorbent was prepared. As a result of performing the water adsorption experiment in the same manner as in Example 2 after vacuum drying said carbon adsorbent at 100° C. for 30 minutes, the water adsorption amount was 0.36 g/g. That is, although the desorption temperature of the adsorbent of Example 2 was 70° C., the adsorbent showed a water adsorption amount that is at least 2.2 times larger than the carbon adsorbent.

Comparative Example 3

SAPO-34 (silicoaluminophosphate) was prepared in reference to U.S. Pat. No. 6,773,688. At that time, the ratio of the starting material was Al:P:Si:TEAOH (tetraethylammonium hydroxide):$H_2O$=1:1:0.3:2:52. SAPO-34 with a surface area of 734 $m^2/g$ and pore volume of 0.57 ml/g was prepared by reacting said precursor solution at 190° C. for 2 days. As a result of performing the water adsorption experiment in the same manner as in Example 2 after vacuum drying said carbon adsorbent at 100° C. for 30 minutes, the water adsorption amount was 0.24 g/g.

Experimental Example 1

Water Adsorption Experiment

After vacuum drying 0.1 g of the adsorbent (porous organic-inorganic hybrid materials [Fe-BTC]) obtained respectively from Examples 8, 9 &12 at 150° C. for 30 minutes, a water adsorption experiment was performed by a gravimetric method. The result is illustrated in FIG. 12.

Figure 12:
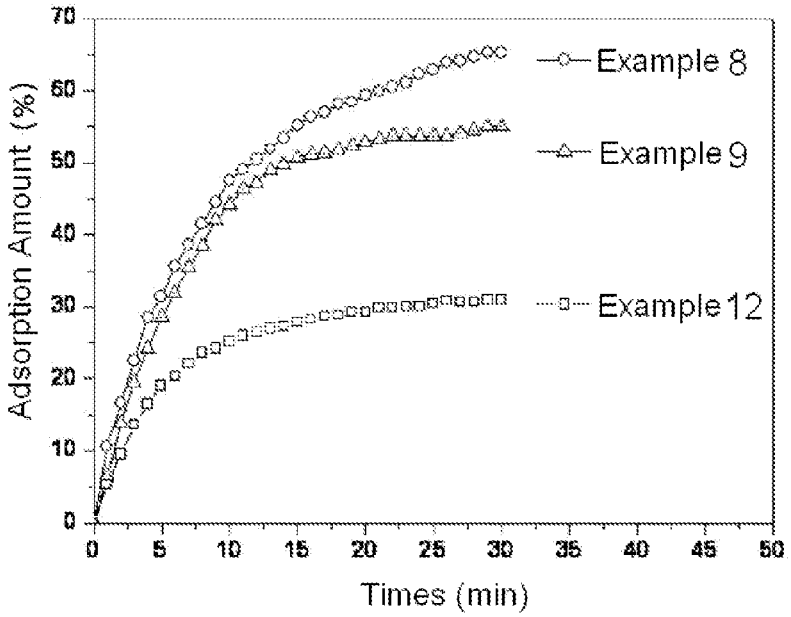
FIG. 12 is a result of a water adsorption experiment according to one illustrative embodiment.

As illustrated in FIG. 12, at a relative humidity of 60%, the water adsorption amount per weight of the adsorbent was measured to be 0.28 g/g in Example 8, 0.31 g/g in Example 9, and 0.19 g/g in Example 12 within the first 5 minutes. In particular, it has been confirmed that the water adsorption rate (initial water adsorption rate) of the entire region from the initial stage of adsorption to 5 minutes is very high. As such, in case of using the porous organic-inorganic hybrid materials as a low-temperature water adsorbent, it can be shown that the adsorbent can easily desorb water at a temperature of 100° C. or below, and using such property, it can achieve a very excellent efficiency in humidifiers, dehumidifiers, etc.

Experimental Example 2

Water Desorption Experiment

Figure 13:
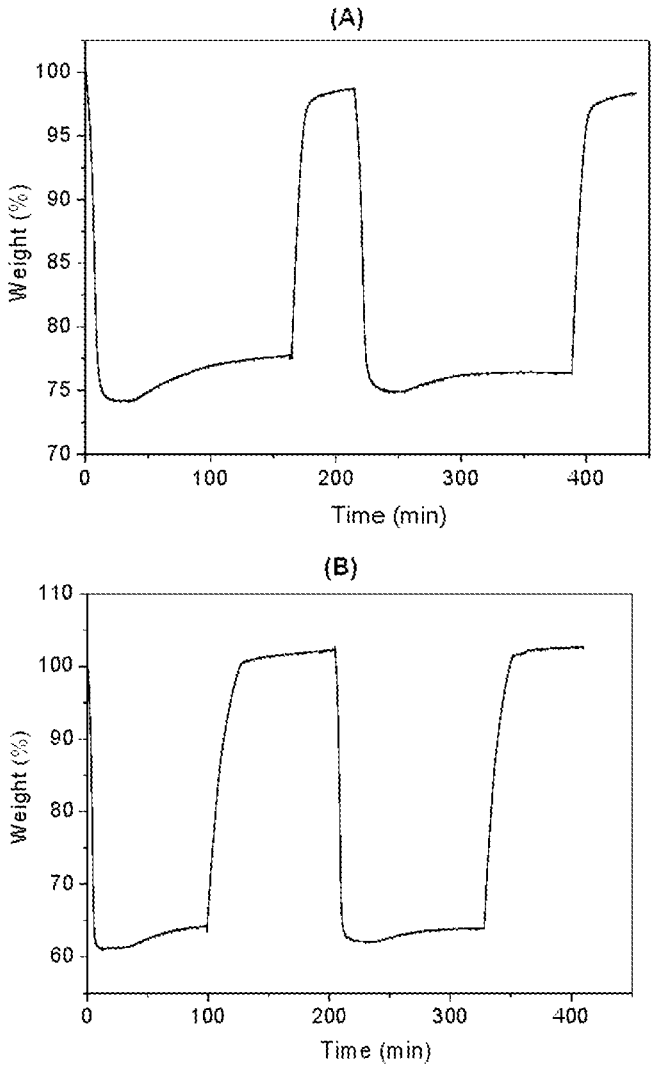
FIG. 13 is a result of a water desorption experiment according to one illustrative embodiment.
Figure 14:
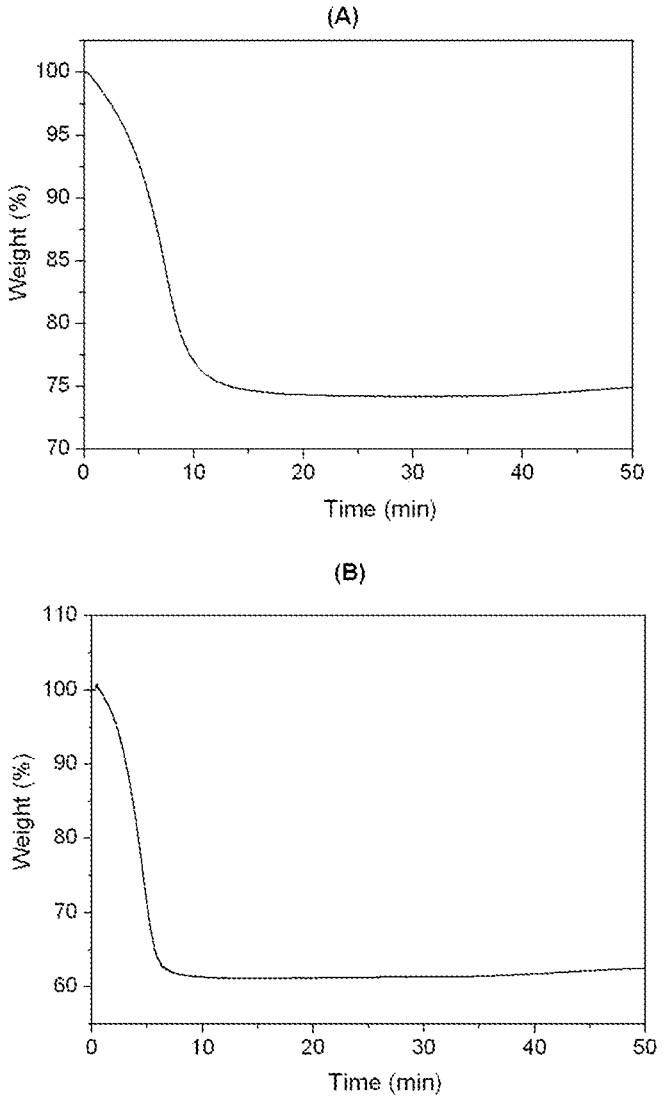
FIG. 14 is a result of a water desorption experiment according to one illustrative embodiment.

After 0.02 g of the adsorbent (porous organic-inorganic hybrid materials [Fe-BTC]) obtained from Example 8 and SAPO-34 obtained from Comparative Example 3 were exposed to the saturated $NH_4Cl$ vapor to sufficiently adsorb water into the adsorbent, the temperature was changed to 70° C. (Fe-BTC) and 100° C. (SAPO-34) and the weight reduction of the adsorbent according to the progress of time was measured by using Thermogravimetric Analysis twice repeatedly (FIG. 13). In comparison with SAPO-34, in case of Fe-BTC, although the desorption experiment was conducted at a temperature of 70° C., it has been confirmed that a water desorption time of 80% by weight was reduced by ½ (FIG. 14 (A) SAPO-34 and FIG. 14 (B) Fe-BTC). In addition, the maximum weight reduction amount is 25% in case of SAPO-34 and 40% in case of Fe-BTC (FIG. 13 (A) SAPO-34 and FIG. 13 (B) Fe-BTC).

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed:

1. An apparatus for treating air by using porous organic-inorganic hybrid materials as an absorbent, comprising:

an inlet passage for receiving air from outside, a dehumidifying part comprising an adsorbent for removing moisture from the air received through the inlet passage, a regenerating unit for regenerating the adsorbent of the dehumidifying part, and an outlet passage for discharging the dehumidified air to outside;

wherein the adsorbent comprises porous organic-inorganic hybrid materials;

which are selected from the group consisting of compounds or their hydrates represented by the following formula:

$M_3X(H_2O)_2O[C_6Z_{4-y}Z'_y(CO_2)_2]_3$(M=Cu, Fe, Mn, Cr, V, Al, Ti, Zr or Mg; X=Cl, Br, I, F or OH; Z or Z'=H, $NH_2$, Br, I, $NO_2$ or OH; $0 \le y \le 4$); or $M_3O(H_2O)_2X[C_6Z_{3-y}Z'_y—(CO_2)_3]_2$(M=Cu, Fe, Mn, Cr, V, Al, Ti, Zr or Mg; X=Cl, Br, I, F or OH; Z or Z'=H, $NH_2$, Br, I, $NO_2$ or OH; $0 \le y \le 3$); or $M_3O\ (H_2O)_2X_{1-y}(OH)_y[C_6H_3—(CO_2)_3]_2$($0 \le y \le 1$; M=Cu, Fe, Mn, Cr, V, Al, Ti, Zr or Mg; X=Cl, Br, I or F); or $M_3X_{1-y}(OH)_y(H_2O)_2O[C_6H_4(CO_2)_2]_3$($0 \le y \le 1$; M=Cu, Fe, Mn, Cr, V, Al, Ti, Zr or Mg; X=Cl, Br, I or F); or $M_6O_4(OH)_4[C_6Z_{4-y}Z'_y(CO_2)_2]_{12}$(M=Ti, Sn or Zr; Z or Z'=H, $NH_2$, Br, I, $No_2$ or OH; $0 \le y \le 4$); or $M_2(dhtp)(H_2O)_2$(M=Ni, Co, Mg, Mn and Fe; *dhtp*=2, 5-dihydroxyterephthalic acid).

2. The apparatus for treating air of claim 1, comprising:

two two-bed switching dehumidifying parts, and two switch valves, wherein two two-bed switching dehumidifying parts may operate alternately for dehumidification and for regeneration using switch valves converting direction of air flow.

3. The apparatus for treating air of claim 1, wherein the porous organic-inorganic hybrid materials may adsorb at least 0.1 g of moisture per 1 g of the porous organic-inorganic hybrid materials.

4. The apparatus for treating air of claim 1, wherein the porous organic-inorganic hybrid materials comprise at least one metal component selected from the group consisting of Sc, Y, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, Mg, Ca, Sr, Ba, Al, Ga, In, Tl, Si, Ge, Sn, Pb, As, Sb and Bi.

5. The apparatus for treating air of claim 1, wherein the porous organic-inorganic hybrid materials comprise at least one metal component selected from the group consisting of Ag(I) , Cu(II or I) and Ni(II), having antibacterial activity.

6. The apparatus for treating air of claim 1, wherein the porous organic-inorganic hybrid materials comprise copper terephthalate, iron terephthalate, manganese terephthalate, chromium terephthalate, vanadium terephthalate, aluminum terephthalate, titanium terephthalate, zirconium terephthalate, magnesium terephthalate, copper benzenetricarboxylate, iron benzenetricarboxylate , manganese benzenetricarboxylate, chromium benzenetricarboxylate, vanadium benzenetricarboxylate, aluminum benzenetricarboxylate, titanium benzenetricarboxylate, zirconium benzenetricarboxylate, magnesium benzenetricarboxylate, iron naphthalenedicarboxylate, chromium naphthalenedicarboxylate, aluminum naphthalenedicarboxylate, nickel dihydroxyterephthalate, cobalt dihydroxyterephthalate, magnesium dihydroxyterephthalate, manganese dihydroxyterephthalate, iron dihydroxyterephthalate, iron benzenetribenzoate, chromium benzenetribenzoate, aluminum benzenetribenzoate, titanium benzenetribenzoate, a derivative thereof, a solvate thereof, a hydrate thereof or a combination of any two or more thereof.

7. The apparatus for treating air of claim 1, wherein the organic ligand is a compound containing at least one functional group selected from the group consisting of carbonic acid group (—CO3H), anion group of carbonic acid (—CO3-), carboxyl group, or anion group of carboxylic acid, amino group (—NH2), imino group ( ) amide group (—CONH2), sulfonic acid group (—SO3H), anion group of sulfonic acid (—SO3-), methanedithioic acid group (—CS2H), anion group of methanedithioic acid (—CS2-), pyridine group and pyrazine group, or a mixture thereof.

8. The apparatus for treating air of claim 1, wherein the porous organic-inorganic hybrid materials have a coordinatively unsaturated metal site to which a surface-functionalizing compound can be bound.

9. The apparatus for treating air of claim 1, wherein the porous organic-inorganic hybrid materials are prepared in a form of powder, thin film, membrane, pellet, ball, foam, slurry, paste, paint, honeycomb, bead, mesh, fiber, corrugated sheet or rotor.

10. The apparatus for treating air of claim 1, wherein the dehumidifying part further comprises at least one metal catalyst selected from the group consisting of platinum, silver, gold, palladium, ruthenium, rhodium, osmium, iridium, manganese, copper, cobalt, chromium, nickel, iron, zinc and a combination of any two or more thereof.

11. The apparatus for treating air of claim 1, capable of eliminating hydrocarbon, NOx, CO or VOC (volatile organic compounds) contained in the air received from outside.

12. The apparatus for treating air of claim 1, wherein the dehumidifying part further comprises at least one dehumidifying agent selected from the group consisting of zeolite, activated alumina, lithium chloride, activated carbon, aluminum silicate, calcium chloride and calcium carbonate.

13. An apparatus for treating air by using porous organic-inorganic hybrid materials as an absorbent, comprising:

an inlet passage for receiving air from outside, a dehumidifying part comprising an adsorbent for removing moisture from the air received through the inlet passage, a regenerating unit for regenerating the adsorbent of the dehumidifying part, and an outlet passage for discharging the dehumidified air to outside;

wherein the adsorbent comprises porous organic-inorganic hybrid materials formed by binding a metal ion with an organic ligand, further comprising, two two-bed switching dehumidifying parts, and two switch valves, wherein two two-bed switching dehumidifying parts may operate alternately for dehumidification and for regeneration using switch valves converting direction of air flow.

14. An apparatus for treating air by using porous organic-inorganic hybrid materials as an absorbent, comprising:

an inlet passage for receiving air from outside, a dehumidifying part comprising an adsorbent for removing moisture from the air received through the inlet passage, a regenerating unit for regenerating the adsorbent of the dehumidifying part, and an outlet passage for discharging the dehumidified air to outside;

wherein the adsorbent comprises porous organic-inorganic hybrid materials formed by binding a metal ion with an organic ligand, wherein the porous organic-inorganic hybrid materials comprise at least one metal component selected from the group consisting of Ag(I) , Cu(II or I) and Ni(II), having antibacterial activity.

* * * * *